US008990074B2

(12) United States Patent
Duni et al.

(10) Patent No.: US 8,990,074 B2
(45) Date of Patent: Mar. 24, 2015

(54) NOISE-ROBUST SPEECH CODING MODE CLASSIFICATION

(75) Inventors: Ethan Robert Duni, San Jose, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 384 days.

(21) Appl. No.: 13/443,647

(22) Filed: Apr. 10, 2012

(65) Prior Publication Data

US 2012/0303362 A1 Nov. 29, 2012

Related U.S. Application Data

(60) Provisional application No. 61/489,629, filed on May 24, 2011.

(51) Int. Cl.

| | |
|---|---|
| ***G10L 19/00*** | (2013.01) |
| ***G10L 19/22*** | (2013.01) |
| ***G10L 25/93*** | (2013.01) |
| *G10L 19/025* | (2013.01) |
| *G10L 25/78* | (2013.01) |

(52) U.S. Cl.

CPC ..... *G10L 19/22* (2013.01); *G10L 25/93* (2013.01); *G10L 19/025* (2013.01); *G10L 25/78* (2013.01)

USPC ..... 704/219; 704/233; 704/221; 704/220; 704/200.1; 455/569.1; 382/260; 381/107; 375/260; 340/572.4

(58) Field of Classification Search

USPC ..... 704/219, 233, 221, 220, 200.1; 455/569.1; 382/260; 381/107; 375/260; 340/572.4

See application file for complete search history.

(56) References Cited

U.S. PATENT DOCUMENTS

| | | | | |
|---|---|---|---|---|
| 4,052,568 | A | 10/1977 | Jankowski | |
| 4,972,484 | A * | 11/1990 | Theile et al. | 704/200.1 |
| 5,596,676 | A | 1/1997 | Swaminathan et al. | |
| 5,742,734 | A | 4/1998 | DeJaco et al. | |
| 5,794,188 | A * | 8/1998 | Hollier | 704/228 |
| 5,909,178 | A * | 6/1999 | Balch et al. | 340/572.4 |
| 6,240,386 | B1 | 5/2001 | Thyssen et al. | |
| 6,484,138 | B2 * | 11/2002 | DeJaco | 704/221 |
| 6,618,701 | B2 | 9/2003 | Piket et al. | |
| 6,691,084 | B2 | 2/2004 | Manjunath et al. | |

(Continued)

FOREIGN PATENT DOCUMENTS

| | | | |
|---|---|---|---|
| CN | 1945696 | A | 4/2007 |
| JP | H0756598 | A | 3/1995 |

(Continued)

OTHER PUBLICATIONS

International Search Report and Written Opinion—PCT/US2012/033372—ISA/EPO—Jun. 29, 2012.

(Continued)

*Primary Examiner* — Michael Colucci
(74) *Attorney, Agent, or Firm* — Austin Rapp & Hardman

(57) ABSTRACT

A method of noise-robust speech classification is disclosed. Classification parameters are input to a speech classifier from external components. Internal classification parameters are generated in the speech classifier from at least one of the input parameters. A Normalized Auto-correlation Coefficient Function threshold is set. A parameter analyzer is selected according to a signal environment. A speech mode classification is determined based on a noise estimate of multiple frames of input speech.

43 Claims, 9 Drawing Sheets

(56) References Cited

U.S. PATENT DOCUMENTS

| | | | | |
|---|---|---|---|---|
| 6,741,873 | B1 * | 5/2004 | Doran et al. | 455/569.1 |
| 6,910,011 | B1 * | 6/2005 | Zakarauskas | 704/233 |
| 7,272,265 | B2 * | 9/2007 | Kouri et al. | 382/260 |
| 7,472,059 | B2 * | 12/2008 | Huang | 704/220 |
| 8,612,222 | B2 * | 12/2013 | Hetherington et al. | 704/233 |
| 2001/0001853 | A1 | 5/2001 | Mauro et al. | |
| 2002/0120440 | A1 | 8/2002 | Zhang | |
| 2006/0198454 | A1 * | 9/2006 | Chung et al. | 375/260 |
| 2009/0265167 | A1 * | 10/2009 | Ehara et al. | 704/219 |
| 2009/0319261 | A1 | 12/2009 | Gupta et al. | |
| 2010/0158275 | A1 * | 6/2010 | Zhang et al. | 381/107 |
| 2011/0035213 | A1 | 2/2011 | Malenovsky et al. | |
| 2011/0238418 | A1 * | 9/2011 | Wang | 704/233 |

FOREIGN PATENT DOCUMENTS

| | | | |
|---|---|---|---|
| KR | 100676216 | B1 | 1/2007 |
| TW | 519615 | B | 2/2003 |
| TW | 535141 | B | 6/2003 |

OTHER PUBLICATIONS

Taiwan Search Report—TW101112862—TIPO—Mar. 17, 2014.

* cited by examiner

NOISE-ROBUST SPEECH CODING MODE CLASSIFICATION

RELATED APPLICATIONS

This application is related to and claims priority from U.S. Provisional Patent Application Ser. No. 61/489,629 filed May 24, 2011, for "Noise-Robust Speech Coding Mode Classification."

TECHNICAL FIELD

The present disclosure relates generally to the field of speech processing. More particularly, the disclosed configurations relate to noise-robust speech coding mode classification.

BACKGROUND

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of 64 kilobits per second (kbps) is required to achieve a speech quality of conventional analog telephone. However, through the use of speech analysis, followed by the appropriate coding, transmission, and re-synthesis at the receiver, a significant reduction in the data rate can be achieved. The more accurately speech analysis can be performed, the more appropriately the data can be encoded, thus reducing the data rate.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder, or a codec. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, de-quantizes them to produce the parameters, and then re-synthesizes the speech frames using the de-quantized parameters.

Modern speech coders may use a multi-mode coding approach that classifies input frames into different types, according to various features of the input speech. Multi-mode variable bit rate encoders use speech classification to accurately capture and encode a high percentage of speech segments using a minimal number of bits per frame. More accurate speech classification produces a lower average encoded bit rate, and higher quality decoded speech. Previously, speech classification techniques considered a minimal number of parameters for isolated frames of speech only, producing few and inaccurate speech mode classifications. Thus, there is a need for a high performance speech classifier to correctly classify numerous modes of speech under varying environmental conditions in order to enable maximum performance of multi-mode variable bit rate encoding techniques.

DETAILED DESCRIPTION

Figure 1:
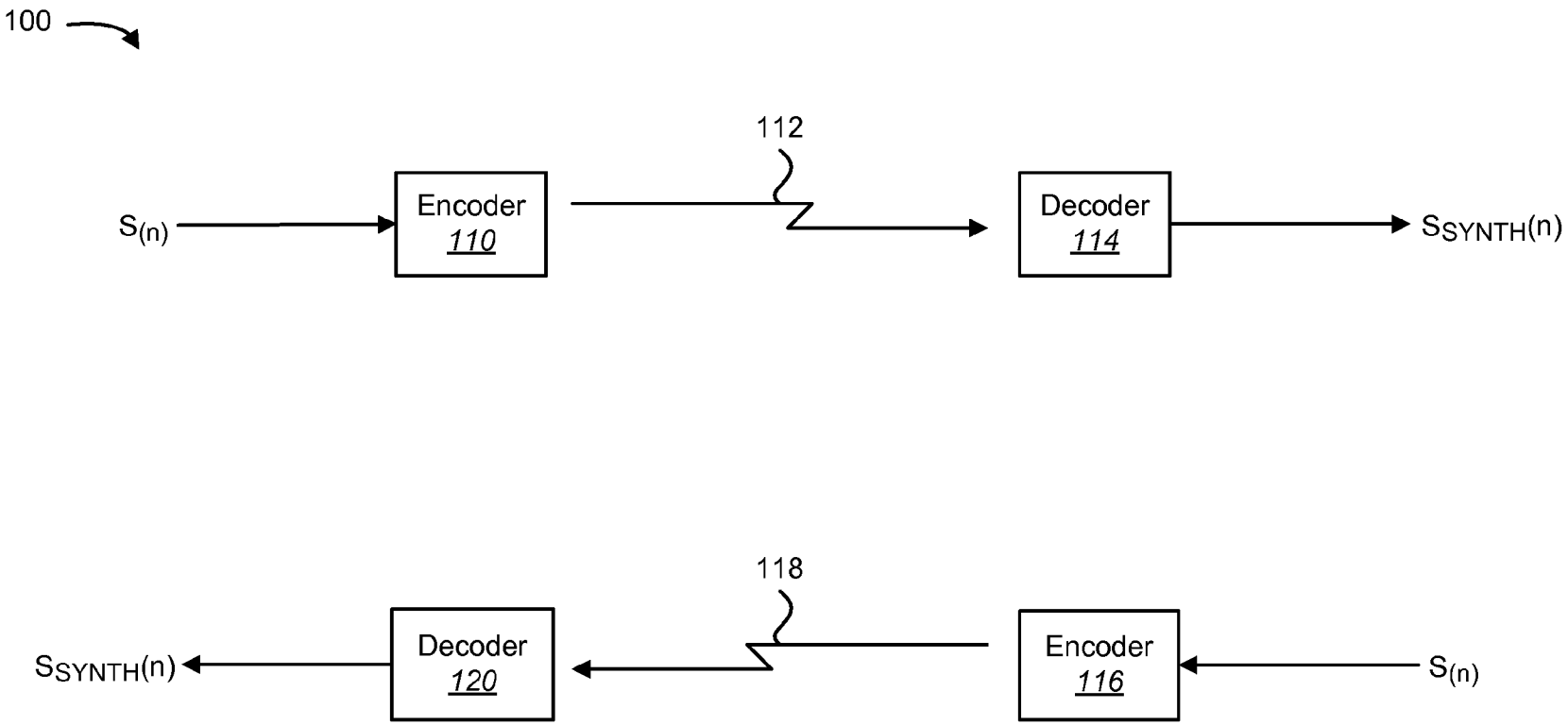
FIG. 1 is a block diagram illustrating a system for wireless communication.

The function of a speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits Ni and the data packet produced by the speech coder has a number of bits No, the compression factor achieved by the speech coder is Cr=Ni/No. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of No bits per frame. The goal of the speech model is thus to capture the essence of the speech signal, or the target voice quality, with a small set of parameters for each frame.

Speech coders may be implemented as time-domain coders, which attempt to capture the time-domain speech waveform by employing high time-resolution processing to encode small segments of speech (typically 5 millisecond (ms) sub-frames) at a time. For each sub-frame, a high-precision representative from a codebook space is found by means of various search algorithms. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with quantization techniques described in A. Gersho & R. M. Gray, Vector Quantization and Signal Compression (1992).

One possible time-domain speech coder is the Code Excited Linear Predictive (CELP) coder described in L. B. Rabiner & R. W. Schafer, Digital Processing of Speech Signals 396-453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding of the LP short-term filter coefficients and encoding the LP residue. Time-domain coding can be performed at a fixed rate (i.e., using the same number of bits, N0, for each frame) or at a variable rate (in which different bit rates are used for different types of frame contents). Variable-rate coders attempt to use only the amount of bits needed to encode the codec parameters to a level adequate to obtain a target quality. One possible variable rate CELP coder is described in U.S. Pat. No. 5,414,796, which is assigned to the assignee of the presently disclosed configurations and fully incorporated herein by reference.

Time-domain coders such as the CELP coder typically rely upon a high number of bits, N0, per frame to preserve the accuracy of the time-domain speech waveform. Such coders typically deliver excellent voice quality provided the number of bits, N0, per frame is relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications.

Typically, CELP schemes employ a short term prediction (STP) filter and a long term prediction (LTP) filter. An Analysis by Synthesis (AbS) approach is employed at an encoder to find the LTP delays and gains, as well as the best stochastic codebook gains and indices. Current state-of-the-art CELP coders such as the Enhanced Variable Rate Coder (EVRC) can achieve good quality synthesized speech at a data rate of approximately 8 kilobits per second.

Furthermore, unvoiced speech does not exhibit periodicity. The bandwidth consumed encoding the LTP filter in the conventional CELP schemes is not as efficiently utilized for unvoiced speech as for voiced speech, where periodicity of speech is strong and LTP filtering is meaningful. Therefore, a more efficient (i.e., lower bit rate) coding scheme is desirable for unvoiced speech. Accurate speech classification is necessary for selecting the most efficient coding schemes, and achieving the lowest data rate.

For coding at lower bit rates, various methods of spectral, or frequency-domain, coding of speech have been developed, in which the speech signal is analyzed as a time-varying evolution of spectra. See, e.g., R. J. McAulay & T. F. Quatieri, Sinusoidal Coding, in Speech Coding and Synthesis ch. 4 (W. B. Kleijn & K. K. Paliwal eds., 1995). In spectral coders, the objective is to model, or predict, the short-term speech spectrum of each input frame of speech with a set of spectral parameters, rather than to precisely mimic the time-varying speech waveform. The spectral parameters are then encoded and an output frame of speech is created with the decoded parameters. The resulting synthesized speech does not match the original input speech waveform, but offers similar perceived quality. Examples of frequency-domain coders include multiband excitation coders (MBEs), sinusoidal transform coders (STCs), and harmonic coders (HCs). Such frequency-domain coders offer a high-quality parametric model having a compact set of parameters that can be accurately quantized with the low number of bits available at low bit rates.

Nevertheless, low-bit-rate coding imposes the critical constraint of a limited coding resolution, or a limited codebook space, which limits the effectiveness of a single coding mechanism, rendering the coder unable to represent various types of speech segments under various background conditions with equal accuracy. For example, conventional low-bit-rate, frequency-domain coders do not transmit phase information for speech frames. Instead, the phase information is reconstructed by using a random, artificially generated, initial phase value and linear interpolation techniques. See, e.g., H. Yang et al., Quadratic Phase Interpolation for Voiced Speech Synthesis in the MBE Model, in 29 Electronic Letters 856-57 (May 1993). Because the phase information is artificially generated, even if the amplitudes of the sinusoids are perfectly preserved by the quantization-de-quantization process, the output speech produced by the frequency-domain coder will not be aligned with the original input speech (i.e., the major pulses will not be in sync). It has therefore proven difficult to adopt any closed-loop performance measure, such as, e.g., signal-to-noise ratio (SNR) or perceptual SNR, in frequency-domain coders.

One effective technique to encode speech efficiently at low bit rate is multi-mode coding. Multi-mode coding techniques have been employed to perform low-rate speech coding in conjunction with an open-loop mode decision process. One such multi-mode coding technique is described in Amitava Das et al., Multi-mode and Variable-Rate Coding of Speech, in Speech Coding and Synthesis ch. 7 (W. B. Kleijn & K. K. Paliwal eds., 1995). Conventional multi-mode coders apply different modes, or encoding-decoding algorithms, to different types of input speech frames. Each mode, or encoding-decoding process, is customized to represent a certain type of speech segment, such as, e.g., voiced speech, unvoiced speech, or background noise (non-speech) in the most efficient manner. The success of such multi-mode coding techniques is highly dependent on correct mode decisions, or speech classifications. An external, open loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures. One possible open-loop mode decision for a speech codec is described in U.S. Pat. No. 5,414,796, which is assigned to the assignee of the present invention and fully incorporated herein by reference.

Multi-mode coding can be fixed-rate, using the same number of bits N0 for each frame, or variable-rate, in which different bit rates are used for different modes. The goal in variable-rate coding is to use only the amount of bits needed to encode the codec parameters to a level adequate to obtain the target quality. As a result, the same target voice quality as that of a fixed-rate, higher-rate coder can be obtained at significant lower average-rate using variable-bit-rate (VBR) techniques. One possible variable rate speech coder is described in U.S. Pat. No. 5,414,796. There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth. A low-rate speech coder coupled with an additional layer of suitable channel coding can fit the overall bit-budget of coder specifications and deliver a robust performance under channel error conditions.

Multi-mode VBR speech coding is therefore an effective mechanism to encode speech at low bit rate. Conventional multi-mode schemes require the design of efficient encoding schemes, or modes, for various segments of speech (e.g., unvoiced, voiced, transition) as well as a mode for background noise, or silence. The overall performance of the speech coder depends on the robustness of the mode classification and how well each mode performs. The average rate of the coder depends on the bit rates of the different modes for unvoiced, voiced, and other segments of speech. In order to achieve the target quality at a low average rate, it is necessary to correctly determine the speech mode under varying conditions. Typically, voiced and unvoiced speech segments are captured at high bit rates, and background noise and silence segments are represented with modes working at a significantly lower rate. Multi-mode variable bit rate encoders require correct speech classification to accurately capture and encode a high percentage of speech segments using a minimal number of bits per frame. More accurate speech classification produces a lower average encoded bit rate, and higher quality decoded speech.

In other words, in source-controlled variable rate coding, the performance of this frame classifier determines the average bit rate based on features of the input speech (energy, voicing, spectral tilt, pitch contour, etc.). The performance of the speech classifier may degrade when the input speech is corrupted by noise. This may cause undesirable effects on the quality and bit rate. Accordingly, methods for detecting the presence of noise and suitably adjusting the classification logic may be used to ensure robust operation in real-world use cases. Furthermore, speech classification techniques previously considered a minimal number of parameters for isolated frames of speech only, producing few and inaccurate speech mode classifications. Thus, there is a need for a high performance speech classifier to correctly classify numerous modes of speech under varying environmental conditions in order to enable maximum performance of multi-mode variable bit rate encoding techniques.

The disclosed configurations provide a method and apparatus for improved speech classification in vocoder applications. Classification parameters may be analyzed to produce speech classifications with relatively high accuracy. A decision making process is used to classify speech on a frame by frame basis. Parameters derived from original input speech may be employed by a state-based decision maker to accurately classify various modes of speech. Each frame of speech may be classified by analyzing past and future frames, as well as the current frame. Modes of speech that can be classified by the disclosed configurations comprise at least transient, transitions to active speech and at the end of words, voiced, unvoiced and silence.

In order to ensure robustness in the classification logic, the present systems and methods may use a multi-frame measure of background noise estimate (which is typically provided by standard up-stream speech coding components, such as a voice activity detector) and adjust the classification logic based on this. Alternatively, an SNR may be used by the classification logic if it includes information about more than one frame, e.g., if it is averaged over multiple frames. In other words, any noise estimate that is relatively stable over multiple frames may be used by the classification logic. The adjustment of classification logic may include changing one or more thresholds used to classify speech. Specifically, the energy threshold for classifying a frame as "unvoiced" may be increased (reflecting the high level of "silence" frames), the voicing threshold for classifying a frame as "unvoiced" may be increased (reflecting the corruption of voicing information under noise), the voicing threshold for classifying a frame as "voiced" may be decreased (again, reflecting the corruption of voicing information), or some combination. In the case where no noise is present, no changes may be introduced to the classification logic. In one configuration with high noise (e.g., 20 dB SNR, typically the lowest SNR tested in speech codec standardization), the unvoiced energy threshold may be increased by 10 dB, the unvoiced voicing threshold may be increased by 0.06, and the voiced voicing threshold may be decreased by 0.2. In this configuration, intermediate noise cases can be handled either by interpolating between the "clean" and "noise" settings, based on the input noise measure, or using a hard threshold set for some intermediate noise level.

FIG. 1 is a block diagram illustrating a system 100 for wireless communication. In the system 100 a first encoder 110 receives digitized speech samples s(n) and encodes the samples s(n) for transmission on a transmission medium 112, or communication channel 112, to a first decoder 114. The decoder 114 decodes the encoded speech samples and synthesizes an output speech signal sSYNTH(n). For transmission in the opposite direction, a second encoder 116 encodes digitized speech samples s(n), which are transmitted on a communication channel 118. A second decoder 120 receives and decodes the encoded speech samples, generating a synthesized output speech signal sSYNTH(n).

The speech samples, s(n), represent speech signals that have been digitized and quantized in accordance with any of various methods including, e.g., pulse code modulation (PCM), companded Haw, or μ-law. In one configuration, the speech samples, s(n), are organized into frames of input data wherein each frame comprises a predetermined number of digitized speech samples s(n). In one configuration, a sampling rate of 8 kHz is employed, with each 20 ms frame comprising 160 samples. In the configurations described below, the rate of data transmission may be varied on a frame-to-frame basis from 8 kbps (full rate) to 4 kbps (half rate) to 2 kbps (quarter rate) to 1 kbps (eighth rate). Alternatively, other data rates may be used. As used herein, the terms "full rate" or "high rate" generally refer to data rates that are greater than or equal to 8 kbps, and the terms "half rate" or "low rate" generally refer to data rates that are less than or equal to 4 kbps. Varying the data transmission rate is beneficial because lower bit rates may be selectively employed for frames containing relatively less speech information. While specific rates are described herein, any suitable sampling rates, frame sizes, and data transmission rates may be used with the present systems and methods.

The first encoder 110 and the second decoder 120 together may comprise a first speech coder, or speech codec. Similarly, the second encoder 116 and the first decoder 114 together comprise a second speech coder. Speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium. Alternatively, any conventional processor, controller, or state machine could be substituted for the microprocessor. Possible ASICs designed specifically for speech coding are described in U.S. Pat. Nos. 5,727,123 and 5,784,532 assigned to the assignee of the present invention and fully incorporated herein by reference.

As an example, without limitation, a speech coder may reside in a wireless communication device. As used herein, the term "wireless communication device" refers to an electronic device that may be used for voice and/or data communication over a wireless communication system. Examples of wireless communication devices include cellular phones, personal digital assistants (PDAs), handheld devices, wireless modems, laptop computers, personal computers, tablets, etc. A wireless communication device may alternatively be referred to as an access terminal, a mobile terminal, a mobile station, a remote station, a user terminal, a terminal, a subscriber unit, a subscriber station, a mobile device, a wireless device, user equipment (UE) or some other similar terminology.

Figure 2A:
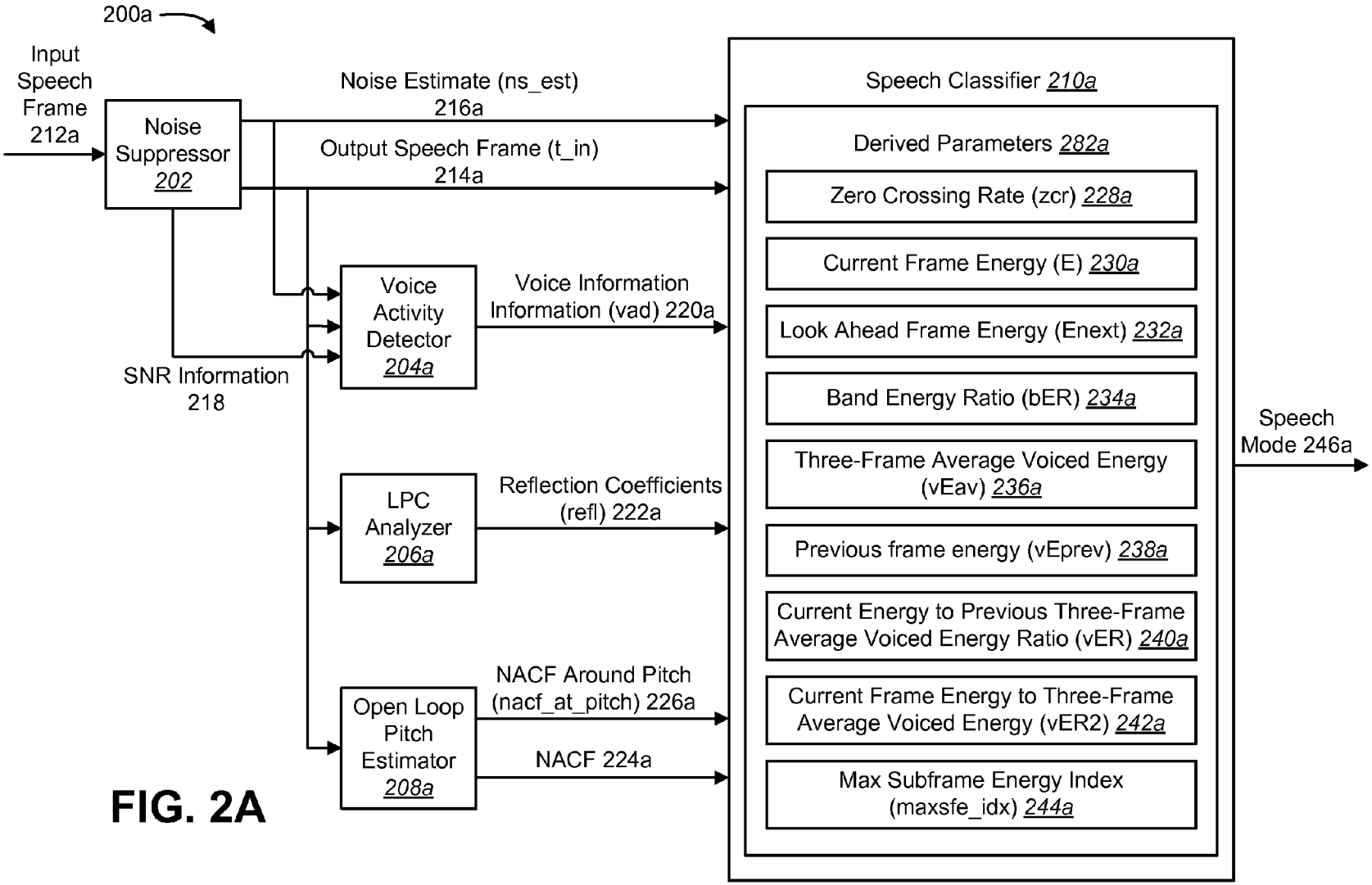
FIG. 2A is a block diagram illustrating a classifier system that may use noise-robust speech coding mode classification.

FIG. 2A is a block diagram illustrating a classifier system 200*a* that may use noise-robust speech coding mode classification. The classifier system 200*a* of FIG. 2A may reside in the encoders illustrated in FIG. 1. In another configuration, the classifier system 200*a* may stand alone, providing speech classification mode output 246*a* to devices such as the encoders illustrated in FIG. 1.

In FIG. 2A, input speech 212*a* is provided to a noise suppresser 202. Input speech 212*a* may be generated by analog to digital conversion of a voice signal. The noise suppresser 202 filters noise components from the input speech 212*a* producing a noise suppressed output speech signal 214*a*. In one configuration, the speech classification apparatus of FIG. 2A may use an Enhanced Variable Rate CODEC (EVRC). As shown, this configuration may include a built-in noise suppressor 202 that determines a noise estimate 216*a* and SNR information 218.

The noise estimate 216*a* and output speech signal 214*a* may be input to a speech classifier 210*a*. The output speech signal 214*a* of the noise suppresser 202 may also be input to a voice activity detector 204*a*, an LPC Analyzer 206*a*, and an open loop pitch estimator 208*a*. The noise estimate 216*a* may also be fed to the voice activity detector 204*a* with SNR information 218 from the noise suppressor 202. The noise estimate 216*a* may be used by the speech classifier 210*a* to set periodicity thresholds and to distinguish between clean and noisy speech.

One possible way to classify speech is to use the SNR information 218. However, the speech classifier 210*a* of the present systems and methods may use the noise estimate 216*a* instead of the SNR information 218. Alternatively, the SNR information 218 may be used if it is relatively stable across multiple frames, e.g., a metric that includes SNR information 218 for multiple frames. The noise estimate 216*a* may be a relatively long term indicator of the noise included in the input speech. The noise estimate 216*a* is hereinafter referred to as ns_est. The output speech signal 214*a* is hereinafter referred to as t_in. If, in one configuration, the noise suppressor 202 is not present, or is turned off, the noise estimate 216*a*, ns_est, may be pre-set to a default value.

One advantage of using a noise estimate 216*a* instead of SNR information 218 is that the noise estimate may be relatively steady on a frame-by-frame basis. The noise estimate 216*a* is only estimating the background noise level, which tends to be relatively constant for long time periods. In one configuration the noise estimate 216*a* may be used to determine the SNR 218 for a particular frame. In contrast, the SNR 218 may be a frame-by-frame measure that may include relatively large swings depending on instantaneous voice energy, e.g., the SNR may swing by many dB between silence frames and active speech frames. Therefore, if SNR information 218 is used for classification, it may be averaged over more than one frame of input speech 212*a*. The relative stability of the noise estimate 216*a* may be useful in distinguishing high-noise situations from simply quiet frames. Even in zero noise, the SNR 218 may still be very low in frames where the speaker is not talking, and so mode decision logic using SNR information 218 may be activated in those frames. The noise estimate 216*a* may be relatively constant unless the ambient noise conditions change, thereby avoiding issue.

The voice activity detector 204*a* may output voice activity information 220*a* for the current speech frame to the speech classifier 210*a*, i.e., based on the output speech 214*a*, the noise estimate 216*a* and the SNR information 218. The voice activity information output 220*a* indicates if the current speech is active or inactive. In one configuration, the voice activity information output 220*a* may be binary, i.e., active or inactive. In another configuration, the voice activity information output 220*a* may be multi-valued. The voice activity information parameter 220*a* is herein referred to as vad.

The LPC analyzer 206*a* outputs LPC reflection coefficients 222*a* for the current output speech to speech classifier 210*a*. The LPC analyzer 206*a* may also output other parameters such as LPC coefficients (not shown). The LPC reflection coefficient parameter 222*a* is herein referred to as refl.

The open loop pitch estimator 208*a* outputs a Normalized Auto-correlation Coefficient Function (NACF) value 224*a*, and NACF around pitch values 226*a*, to the speech classifier 210*a*. The NACF parameter 224*a* is hereinafter referred to as nacf, and the NACF around pitch parameter 226*a* is hereinafter referred to as nacf_at_pitch. A more periodic speech signal produces a higher value of nacf_at_pitch 226*a*. A higher value of nacf_at_pitch 226*a* is more likely to be associated with a stationary voice output speech type. The speech classifier 210*a* maintains an array of nacf_at_pitch values 226*a*, which may be computed on a sub-frame basis. In one configuration, two open loop pitch estimates are measured for each frame of output speech 214*a* by measuring two sub-frames per frame. The NACF around pitch (nacf_at_pitch) 226*a* may be computed from the open loop pitch estimate for each sub-frame. In one configuration, a five dimensional array of nacf_at_pitch values 226*a* (i.e. nacf_at_pitch[4]) contains values for two and one-half frames of output speech 214*a*. The nacf_at_pitch array is updated for each frame of output speech 214*a*. The use of an array for the nacf_at_pitch parameter 226*a* provides the speech classifier 210*a* with the ability to use current, past, and look ahead (future) signal information to make more accurate and noise-robust speech mode decisions.

In addition to the information input to the speech classifier 210*a* from external components, the speech classifier 210*a* internally generates derived parameters 282*a* from the output speech 214*a* for use in the speech mode decision making process.

In one configuration, the speech classifier 210*a* internally generates a zero crossing rate parameter 228*a*, hereinafter referred to as zcr. The zcr parameter 228*a* of the current output speech 214*a* is defined as the number of sign changes in the speech signal per frame of speech. In voiced speech, the zcr value 228*a* is low, while unvoiced speech (or noise) has a high zcr value 228*a* because the signal is very random. The zcr parameter 228*a* is used by the speech classifier 210*a* to classify voiced and unvoiced speech.

In one configuration, the speech classifier 210*a* internally generates a current frame energy parameter 230*a*, hereinafter referred to as E. E 230*a* may be used by the speech classifier 210*a* to identify transient speech by comparing the energy in the current frame with energy in past and future frames. The parameter vEprev is the previous frame energy derived from E 230*a*.

In one configuration, the speech classifier 210*a* internally generates a look ahead frame energy parameter 232*a*, hereinafter referred to as Enext. Enext 232*a* may contain energy values from a portion of the current frame and a portion of the next frame of output speech. In one configuration, Enext 232*a* represents the energy in the second half of the current frame and the energy in the first half of the next frame of output speech. Enext 232*a* is used by speech classifier 210*a* to identify transitional speech. At the end of speech, the energy of the next frame 232*a* drops dramatically compared to the energy of the current frame 230*a*. Speech classifier 210*a* can compare the energy of the current frame 230*a* and the energy of the next frame 232*a* to identify end of speech and beginning of speech conditions, or up transient and down transient speech modes.

In one configuration, the speech classifier 210*a* internally generates a band energy ratio parameter 234*a*, defined as log 2(EL/EH), where EL is the low band current frame energy from 0 to 2 kHz, and EH is the high band current frame energy from 2 kHz to 4 kHz. The band energy ratio parameter 234*a* is hereinafter referred to as bER. The bER 234*a* parameter allows the speech classifier 210*a* to identify voiced speech and unvoiced speech modes, as in general, voiced speech concentrates energy in the low band, while noisy unvoiced speech concentrates energy in the high band.

In one configuration, the speech classifier 210*a* internally generates a three-frame average voiced energy parameter 236*a* from the output speech 214*a*, hereinafter referred to as vEay. In other configurations, vEav 236*a* may be averaged over a number of frames other than three. If the current speech mode is active and voiced, vEav 236*a* calculates a running average of the energy in the last three frames of output speech. Averaging the energy in the last three frames of output speech provides the speech classifier 210*a* with more stable statistics on which to base speech mode decisions than single frame energy calculations alone. vEav 236*a* is used by the speech classifier 210*a* to classify end of voice speech, or down transient mode, as the current frame energy 230*a*, E, will drop dramatically compared to average voice energy 236*a*, vEav, when speech has stopped. vEav 236*a* is updated only if the current frame is voiced, or reset to a fixed value for unvoiced or inactive speech. In one configuration, the fixed reset value is 0.01.

In one configuration, the speech classifier 210*a* internally generates a previous three frame average voiced energy parameter 238*a*, hereinafter referred to as vEprev. In other configurations, vEprev 238*a* may be averaged over a number of frames other than three. vEprev 238*a* is used by speech classifier 210*a* to identify transitional speech. At the beginning of speech, the energy of the current frame 230*a* rises dramatically compared to the average energy of the previous three voiced frames 238*a*. Speech classifier 210 can compare the energy of the current frame 230*a* and the energy previous three frames 238*a* to identify beginning of speech conditions, or up transient and speech modes. Similarly at the end of voiced speech, the energy of the current frame 230*a* drops off dramatically. Thus, vEprev 238*a* may also be used to classify transition at end of speech.

In one configuration, the speech classifier 210*a* internally generates a current frame energy to previous three-frame average voiced energy ratio parameter 240*a*, defined as 10*log 10(E/vEprev). In other configurations, vEprev 238*a* may be averaged over a number of frames other than three. The current energy to previous three-frame average voiced energy ratio parameter 240*a* is hereinafter referred to as vER. vER 240*a* is used by the speech classifier 210*a* to classify start of voiced speech and end of voiced speech, or up transient mode and down transient mode, as vER 240*a* is large when speech has started again and is small at the end of voiced speech. The vER 240*a* parameter may be used in conjunction with the vEprev 238*a* parameter in classifying transient speech.

In one configuration, the speech classifier 210*a* internally generates a current frame energy to three-frame average voiced energy parameter 242*a*, defined as MIN(20,10*log 10(E/vEav)). The current frame energy to three-frame average voiced energy 242*a* is hereinafter referred to as vER2. vER2 242*a* is used by the speech classifier 210*a* to classify transient voice modes at the end of voiced speech.

In one configuration, the speech classifier 210*a* internally generates a maximum sub-frame energy index parameter 244*a*. The speech classifier 210*a* evenly divides the current frame of output speech 214*a* into sub-frames, and computes the Root Means Squared (RMS) energy value of each sub-frame. In one configuration, the current frame is divided into ten sub-frames. The maximum sub-frame energy index parameter is the index to the sub-frame that has the largest RMS energy value in the current frame, or in the second half of the current frame. The max sub-frame energy index parameter 244*a* is hereinafter referred to as maxsfe_idx. Dividing the current frame into sub-frames provides the speech classifier 210*a* with information about locations of peak energy, including the location of the largest peak energy, within a frame. More resolution is achieved by dividing a frame into more sub-frames. The maxsfe_idx parameter 244*a* is used in conjunction with other parameters by the speech classifier 210*a* to classify transient speech modes, as the energies of unvoiced or silence speech modes are generally stable, while energy picks up or tapers off in a transient speech mode.

The speech classifier 210*a* may use parameters input directly from encoding components, and parameters generated internally, to more accurately and robustly classify modes of speech than previously possible. The speech classifier 210*a* may apply a decision making process to the directly input and internally generated parameters to produce improved speech classification results. The decision making process is described in detail below with references to FIGS. 4A-4C and Tables 4-6.

In one configuration, the speech modes output by speech classifier 210 comprise: Transient, Up-Transient, Down-Transient, Voiced, Unvoiced, and Silence modes. Transient mode is a voiced but less periodic speech, optimally encoded with full rate CELP. Up-Transient mode is the first voiced frame in active speech, optimally encoded with full rate CELP. Down-transient mode is low energy voiced speech typically at the end of a word, optimally encoded with half rate CELP. Voiced mode is a highly periodic voiced speech, comprising mainly vowels. Voiced mode speech may be encoded at full rate, half rate, quarter rate, or eighth rate. The data rate for encoding voiced mode speech is selected to meet Average Data Rate (ADR) requirements. Unvoiced mode, comprising mainly consonants, is optimally encoded with quarter rate Noise Excited Linear Prediction (NELP). Silence mode is inactive speech, optimally encoded with eighth rate CELP.

Suitable parameters and speech modes are not limited to the specific parameters and speech modes of the disclosed configurations. Additional parameters and speech modes can be employed without departing from the scope of the disclosed configurations.

Figure 2B:
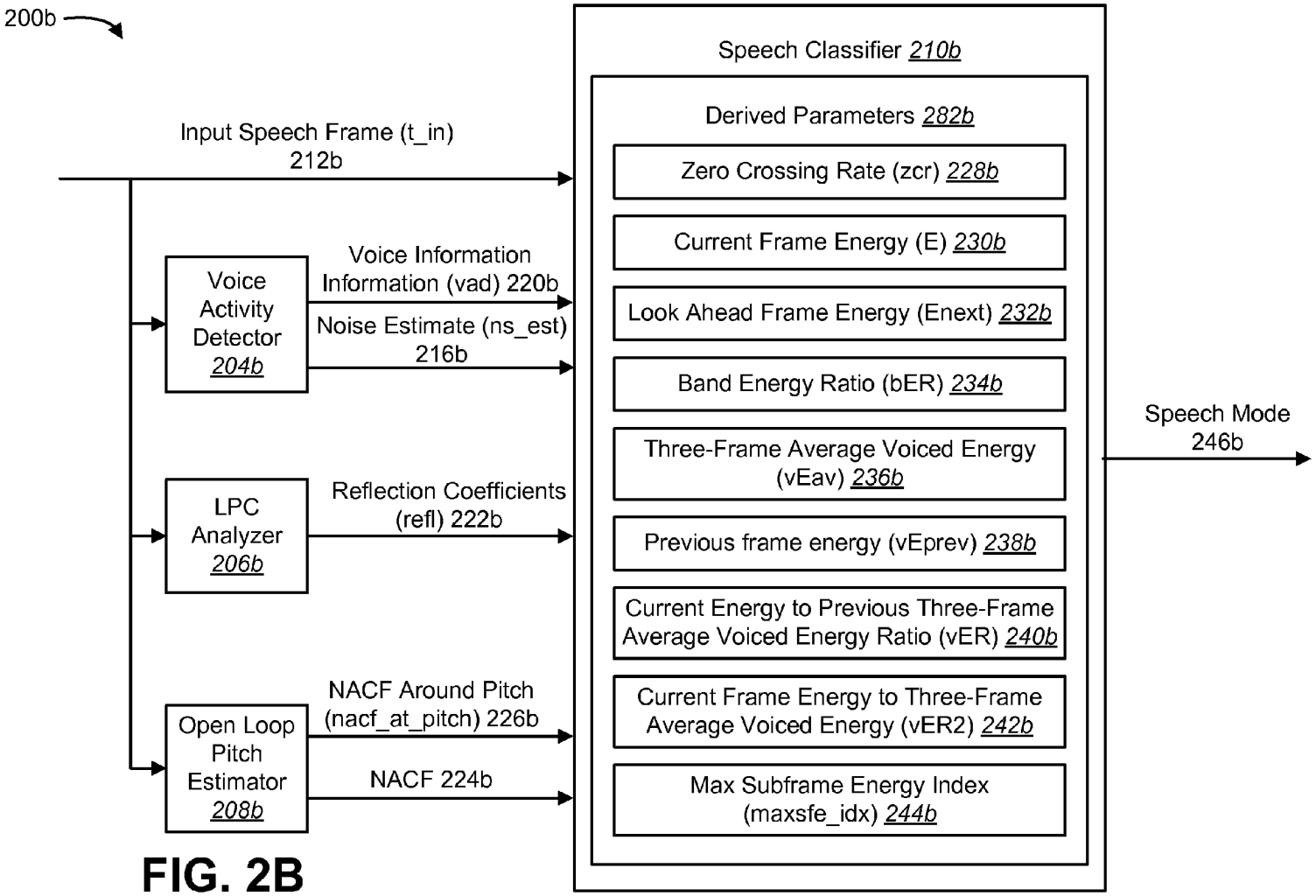
FIG. 2B is a block diagram illustrating another classifier system that may use noise-robust speech coding mode classification.

FIG. 2B is a block diagram illustrating another classifier system 200*b* that may use noise-robust speech coding mode classification. The classifier system 200*b* of FIG. 2B may reside in the encoders illustrated in FIG. 1. In another configuration, the classifier system 200*b* may stand alone, providing speech classification mode output to devices such as the encoders illustrated in FIG. 1. The classifier system 200*b* illustrated in FIG. 2B may include elements that correspond to the classifier system 200*a* illustrated in FIG. 2A. Specifically, the LPC analyzer 206*b*, open loop pitch estimator 208*b* and speech classifier 210*b* illustrated in FIG. 2B may correspond to and include similar functionality as the LPC analyzer 206*a*, open loop pitch estimator 208*a* and speech classifier 210*a* illustrated in FIG. 2A, respectively. Similarly, the speech classifier 210*b* inputs in FIG. 2B (voice activity information 220*b*, reflection coefficients 222*b*, NACF 224*b* and NACF around pitch 226*b*) may correspond to the speech classifier 210*a* inputs (voice activity information 220*a*, reflection coefficients 222*a*, NACF 224*a* and NACF around pitch 226*a*) in FIG. 2A, respectively. Similarly, the derived parameters 282*b* in FIG. 2B (zcr 228*b*, E 230*b*, Enext 232*b*, bER 234*b*, vEav 236*b*, vEprev 238*b*, vER 240*b*, vER2 242*b* and maxsfe_idx 244*b*) may correspond to the derived parameters 282*a* in FIG. 2A (zcr 228*a*, E 230*a*, Enext 232*a*, bER 234*a*, vEav 236*a*, vEprev 238*a*, vER 240*a*, vER2 242*a* and maxsfe_idx 244*a*), respectively.

In FIG. 2B, there is no included noise suppressor. In one configuration, the speech classification apparatus of FIG. 2B may use an Enhanced Voice Services (EVS) CODEC. The apparatus of FIG. 2B may receive the input speech frames 212*b* from a noise suppressing component external to the speech codec. Alternatively, there may be no noise suppression performed. Since there is no included noise suppressor 202, the noise estimate, ns_est, 216*b* may be determined by the voice activity detector 204*a*. While FIGS. 2A-2B describe two configurations where the noise estimate 216*b* is determined by a noise suppressor 202 and a voice activity detector 204*b*, respectively, the noise estimate 216*a-b* may be determined by any suitable module, e.g., a generic noise estimator (not shown).

Figure 3:
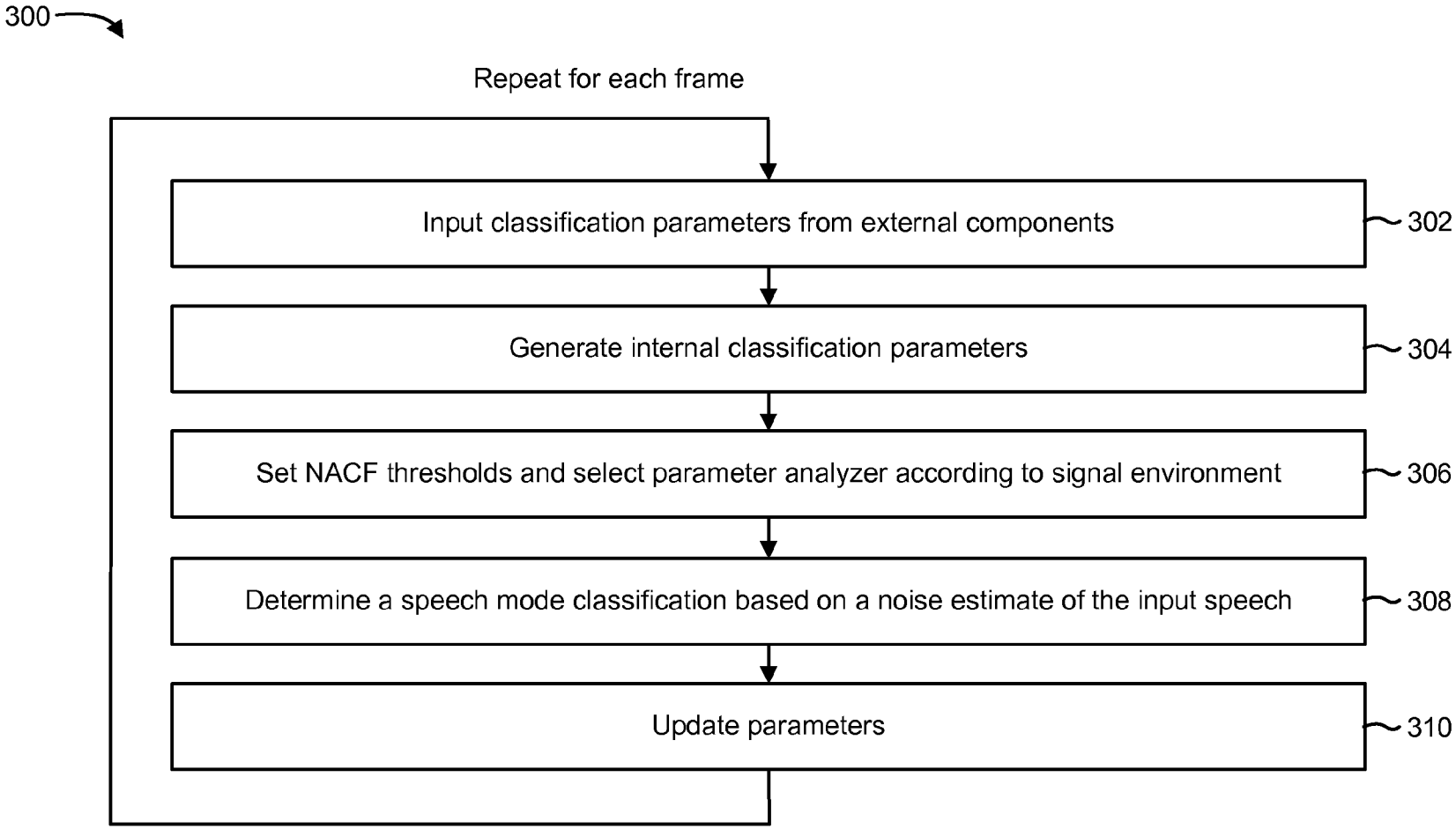
FIG. 3 is a flow chart illustrating a method of noise-robust speech classification.

FIG. 3 is a flow chart illustrating a method 300 of noise-robust speech classification. In step 302, classification parameters input from external components are processed for each frame of noise suppressed output speech. In one configuration, (e.g., the classifier system 200*a* illustrated in FIG. 2A), classification parameters input from external components comprise ns_est 216*a* and *t*_in 214*a* input from a noise suppresser component 202, nacf 224*a* and nacf_at_pitch 226*a* parameters input from an open loop pitch estimator component 208*a*, vad 220*a* input from a voice activity detector component 204*a*, and refl 222*a* input from an LPC analysis component 206*a*. Alternatively, ns_est 216*b* may be input from a different module, e.g., a voice activity detector 204*b* as illustrated in FIG. 2B. The t_in 214*a-b* input may be the output speech frames 214*a* from a noise suppressor 202 as in FIG. 2A or input frames as 212*b* in FIG. 2B. Control flow proceeds to step 304.

In step 304, additional internally generated derived parameters 282*a-b* are computed from classification parameters input from external components. In one configuration, zcr 228*a-b*, E 230*a-b*, Enext 232*a-b*, bER 234*a-b*, vEav 236*a-b*, vEprev 238*a-b*, vER 240*a-b*, vER2 242*a-b* and maxsfe_idx 244*a-b* are computed from t_in 214*a-b*. When internally generated parameters have been computed for each output speech frame, control flow proceeds to step 306.

In step 306, NACF thresholds are determined, and a parameter analyzer is selected according to the environment of the speech signal. In one configuration, the NACF threshold is determined by comparing the ns_est parameter 216*a-b* input in step 302 to a noise estimate threshold value. The ns_est information 216*a-b* may provide an adaptive control of a periodicity decision threshold. In this manner, different periodicity thresholds are applied in the classification process for speech signals with different levels of noise components. This may produce a relatively accurate speech classification decision when the most appropriate NACF, or periodicity, threshold for the noise level of the speech signal is selected for each frame of output speech. Determining the most appropriate periodicity threshold for a speech signal allows the selection of the best parameter analyzer for the speech signal. Alternatively, SNR information 218 may be used to determine the NACF threshold, if the SNR information 218 includes information about multiple frames and is relatively stable from frame to frame.

Clean and noisy speech signals inherently differ in periodicity. When noise is present, speech corruption is present. When speech corruption is present, the measure of the periodicity, or nacf 224*a-b*, is lower than that of clean speech. Thus, the NACF threshold is lowered to compensate for a noisy signal environment or raised for a clean signal environment. The speech classification technique of the disclosed systems and methods may adjust periodicity (i.e., NACF) thresholds for different environments, producing a relatively accurate and robust mode decision regardless of noise levels.

In one configuration, if the value of ns_est 216*a-b* is less than or equal to a noise estimate threshold, NACF thresholds for clean speech are applied. Possible NACF thresholds for clean speech may be defined by the following table:

TABLE 1

| Threshold for Type | Threshold Name | Threshold Value |
|---|---|---|
| Voiced | VOICEDTH | .605 |
| Transitional | LOWVOICEDTH | .5 |
| Unvoiced | UNVOICEDTH | .35 |

However, depending on the value of ns_est 216*a-b*, various thresholds may be adjusted. For example, if the value of ns_est 216*a-b* is greater than a noise estimate threshold, NACF thresholds for noisy speech may be applied. The noise estimate threshold may be any suitable value, e.g., 20 dB, 25 dB, etc. In one configuration, the noise estimate threshold is set to be above what is observed under clean speech and below what is observed in very noisy speech. Possible NACF thresholds for noisy speech may be defined by the following table:

TABLE 2

| Threshold for Type | Threshold Name | Threshold Value |
|---|---|---|
| Voiced | VOICEDTH | .585 |
| Transitional | LOWVOICEDTH | .5 |
| Unvoiced | UNVOICEDTH | .35 |

In the case where no noise is present (i.e., ns_est 216*a-b* does not exceed the noise estimate threshold), the voicing thresholds may not be adjusted. However, the voicing NACF threshold for classifying a frame as "voiced" may be decreased (reflecting the corruption of voicing information) when there is high noise in the input speech. In other words, the voicing threshold for classifying "voiced" speech may be decreased by 0.2, as seen in Table 2 when compared to Table 1.

Alternatively, or in addition to, modifying the NACF thresholds for classifying "voiced" frames, the speech classifier 210*a-b* may adjust one or more thresholds for classifying "unvoiced" frames based on the value of ns_est 216*a-b*. There may be two types of NACF thresholds for classifying "unvoiced" frames that are adjusted based on the value of ns_est 216*a-b*: a voicing threshold and an energy threshold. Specifically, the voicing NACF threshold for classifying a frame as "unvoiced" may be increased (reflecting the corruption of voicing information under noise). For example, the "unvoiced" voicing NACF threshold may increase by 0.06 in the presence of high noise (i.e., when ns_est 216*a-b* exceeds the noise estimate threshold), thereby making the classifier more permissive in classifying frames as "unvoiced." If multi-frame SNR information 218 is used instead of ns_est 216*a-b*, a low SNR (indicating the presence of high noise), the "unvoiced" voicing threshold may increase by 0.06. Examples of adjusted voicing NACF thresholds may be given according to Table 3:

TABLE 3

| Threshold for Type | Threshold Name | Threshold Value |
|---|---|---|
| Voiced | VOICEDTH | .75 |
| Transitional | LOWVOICEDTH | .5 |
| Unvoiced | UNVOICEDTH | .41 |

The energy threshold for classifying a frame as "unvoiced" may also be increased (reflecting the high level of "silence" frames) in the presence of high noise, i.e., when ns_est 216*a-b* exceeds the noise estimate threshold. For example, the unvoiced energy threshold may increase by 10 dB in high noise frames, e.g., the energy threshold may be increased from −25 dB in the clean speech case to −15 dB in the noisy case. Increasing the voicing threshold and the energy threshold for classifying a frame as "unvoiced" may make it easier (i.e., more permissive) to classify a frame as unvoiced as the noise estimate gets higher (or the SNR gets lower). Thresholds for intermediate noise frames (e.g., when ns_est 216*a-b* does not exceed the noise estimate threshold but is above a minimum noise measure) may be adjusted by interpolating between the "clean" settings (Table 1) and "noise" settings (Table 2 and/or Table 3), based on the input noise estimate. Alternatively, hard threshold sets may be defined for some intermediate noise estimates.

The "voiced" voicing threshold may be adjusted independently of the "unvoiced" voicing and energy thresholds. For example, the "voiced" voicing threshold may be adjusted but neither the "unvoiced" voicing or energy thresholds may be adjusted. Alternatively, one or both of the "unvoiced" voicing and energy thresholds may be adjusted but the "voiced" voicing threshold may not be adjusted. Alternatively, the "voiced" voicing threshold may be adjusted with only one of the "unvoiced" voicing and energy thresholds.

Noisy speech is the same as clean speech with added noise. With adaptive periodicity threshold control, the robust speech classification technique may be more likely to produce identical classification decisions for clean and noisy speech than previously possible. When the nacf thresholds have been set for each frame, control flow proceeds to step 308.

In step 308, a speech mode classification 246*a-b* is determined based, at least in part, on the noise estimate. A state machine or any other method of analysis selected according to the signal environment is applied to the parameters. In one configuration, the parameters input from external components and the internally generated parameters are applied to a state based mode decision making process described in detail with reference to FIGS. 4A-4C and Tables 4-6. The decision making process produces a speech mode classification. In one configuration, a speech mode classification 246*a-b* of Transient, Up-Transient, Down Transient, Voiced, Unvoiced, or Silence is produced. When a speech mode decision 246*a-b* has been produced, control flow proceeds to step 310.

In step 310, state variables and various parameters are updated to include the current frame. In one configuration, vEav 236*a-b*, vEprev 238*a-b*, and the voiced state of the current frame are updated. The current frame energy E 230*a-b*, nacf_at_pitch 226*a-b*, and the current frame speech mode 246*a-b* are updated for classifying the next frame. Steps 302-310 may be repeated for each frame of speech.

Figure 4A:
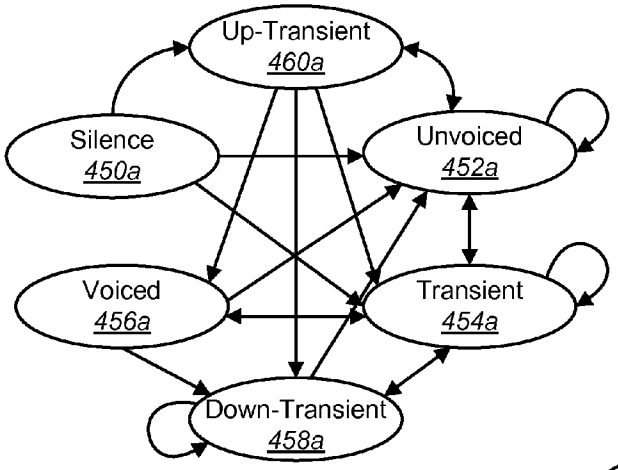
FIGS. 4A-4C illustrate configurations of the mode decision making process for noise-robust speech classification.
Figure 4B:
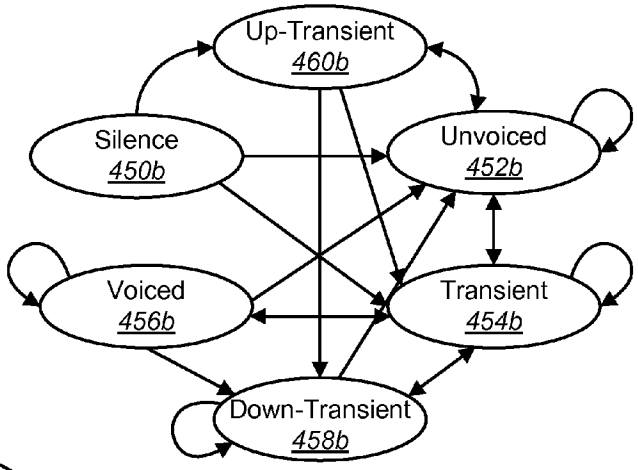
Figure 4C:
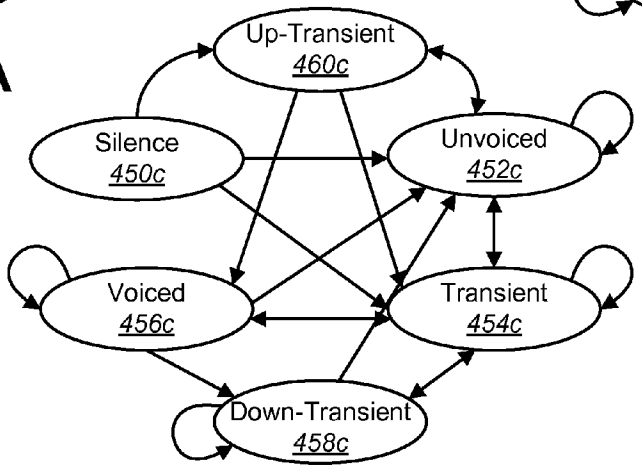

FIGS. 4A-4C illustrate configurations of the mode decision making process for noise-robust speech classification. The decision making process selects a state machine for speech classification based on the periodicity of the speech frame. For each frame of speech, a state machine most compatible with the periodicity, or noise component, of the speech frame is selected for the decision making process by comparing the speech frame periodicity measure, i.e. nacf_at_pitch value 226*a-b*, to the NACF thresholds set in step 304 of FIG. 3. The level of periodicity of the speech frame limits and controls the state transitions of the mode decision process, producing a more robust classification.

FIG. 4A illustrates one configuration of the state machine selected in one configuration when vad 220*a-b* is 1 (there is active speech) and the third value of nacf_at_pitch 226*a-b* (i.e. nacf_at_pitch[2], zero indexed) is very high, or greater than VOICEDTH. VOICEDTH is defined in step 306 of FIG. 3. Table 4 illustrates the parameters evaluated by each state:

TABLE 4

| | PREVIOUS | | | | | |
|---|---|---|---|---|---|---|
| CURRENT | SILENCE | UNVOICED | VOICED | UP-TRANSIENT | TRANSIENT | DOWN-TRANSIENT |
| SILENCE | Vad = 0 | nacf_ap[3] very low, zcr high, bER low, vER very low | X | DEFAULT | X | X |
| UNVOICED | Vad = 0 | nacf_ap[3] very low, nacf_ap[4] very low, nacf very low, zcr high, bER low, vER very low, E < vEprev | X | DEFAULT | X | X |

TABLE 4-continued

| | PREVIOUS | | | | | |
|---|---|---|---|---|---|---|
| CURRENT | SILENCE | UNVOICED | VOICED | UP-TRANSIENT | TRANSIENT | DOWN-TRANSIENT |
| VOICED | Vad = 0 | vER very low, E < vEprev | DEFAULT | X | nacf_ap[1] low, nacf_ap[3] low, E > 0.5 * vEprev | vER very low, nacf_ap[3] not too high, |
| UP-TRANSIENT, TRANSIENT | Vad = 0 | vER very low, E < vEprev | DEFAULT | X | nacf_ap[1] low, nacf_ap[3] not too high, nacf_ap[4] low, previous classification is not transient | nacf_ap[3] not too high, E > 0.05 * vEav |
| DOWN-TRANSIENT | Vad = 0 | vER very low, | X | X | E > vEprev | DEFAULT |

Table 4, in accordance with one configuration, illustrates the parameters evaluated by each state, and the state transitions when the third value of nacf_at_pitch 226*a-b* (i.e. nacf_at_pitch[2]) is very high, or greater than VOICEDTH. The decision table illustrated in Table 4 is used by the state machine described in FIG. 4A. The speech mode classification 246*a-b* of the previous frame of speech is shown in the leftmost column. When parameters are valued as shown in the row associated with each previous mode, the speech mode classification transitions to the current mode identified in the top row of the associated column.

The initial state is Silence 450*a*. The current frame will always be classified as Silence 450*a*, regardless of the previous state, if vad=0 (i.e., there is no voice activity).

When the previous state is Silence 450*a*, the current frame may be classified as either Unvoiced 452*a* or Up-Transient 460*a*. The current frame is classified as Unvoiced 452*a* if nacf_at_pitch[3] is very low, zcr 228*a-b* is high, bER 234*a-b* is low and vER 240*a-b* is very low, or if a combination of these conditions are met. Otherwise the classification defaults to Up-Transient 460*a*.

When the previous state is Unvoiced 452*a*, the current frame may be classified as Unvoiced 452*a* or Up-Transient 460*a*. The current frame remains classified as Unvoiced 452*a* if nacf 224*a-b* is very low, nacf_at_pitch[3] is very low, nacf_at_pitch[4] is very low, zcr 228*a-b* is high, bER 234*a-b* is low, vER 240*a-b* is very low, and E 230*a-b* is less than vEprev 238*a-b*, or if a combination of these conditions are met. Otherwise the classification defaults to Up-Transient 460*a*.

When the previous state is Voiced 456*a*, the current frame may be classified as Unvoiced 452*a*, Transient 454*a*, Down-Transient 458*a*, or Voiced 456*a*. The current frame is classified as Unvoiced 452*a* if vER 240*a-b* is very low, and E 230*a* is less than vEprev 238*a-b*. The current frame is classified as Transient 454*a* if nacf_at_pitch[1] and nacf_at_pitch[3] are low, E 230*a-b* is greater than half of vEprev 238*a-b*, or a combination of these conditions are met. The current frame is classified as Down-Transient 458*a* if vER 240*a-b* is very low, and nacf_at_pitch[3] has a moderate value. Otherwise, the current classification defaults to Voiced 456*a*.

When the previous state is Transient 454*a* or Up-Transient 460*a*, the current frame may be classified as Unvoiced 452*a*, Transient 454*a*, Down-Transient 458*a* or Voiced 456*a*. The current frame is classified as Unvoiced 452*a* if vER 240*a-b* is very low, and E 230*a-b* is less than vEprev 238*a-b*. The current frame is classified as Transient 454*a* if nacf_at_pitch[1] is low, nacf_at_pitch[3] has a moderate value, nacf_at_pitch[4] is low, and the previous state is not Transient 454*a*, or if a combination of these conditions are met. The current frame is classified as Down-Transient 458*a* if nacf_at_pitch[3] has a moderate value, and E 230*a-b* is less than 0.05 times vEav 236*a-b*. Otherwise, the current classification defaults to Voiced 456*a-b*.

When the previous frame is Down-Transient 458*a*, the current frame may be classified as Unvoiced 452*a*, Transient 454*a* or Down-Transient 458*a*. The current frame will be classified as Unvoiced 452*a* if vER 240*a-b* is very low. The current frame will be classified as Transient 454*a* if E 230*a-b* is greater than vEprev238*a-b*. Otherwise, the current classification remains Down-Transient 458*a*.

FIG. 4B illustrates one configuration of the state machine selected in one configuration when vad 220*a-b* is 1 (there is active speech) and the third value of nacf_at_pitch 226*a-b* is very low, or less than UNVOICEDTH. UNVOICEDTH is defined in step 306 of FIG. 3. Table 5 illustrates the parameters evaluated by each state.

TABLE 5

| | PREVIOUS | | | | | |
|---|---|---|---|---|---|---|
| CURRENT | SILENCE | UNVOICED | VOICED | UP-TRANSIENT | TRANSIENT | DOWN-TRANSIENT |
| SILENCE | Vad = 0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low | X | X |

TABLE 5-continued

| | PREVIOUS | | | | | |
|---|---|---|---|---|---|---|
| CURRENT | SILENCE | UNVOICED | VOICED | UP-TRANSIENT | TRANSIENT | DOWN-TRANSIENT |
| UNVOICED | Vad = 0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low, nacf_ap[3] very high, nacf_ap[4] very high, refl low, E > vEprev, nacf not to low, etc. | X | X |
| VOICED, UP-TRANSIENT, TRANSIENT | Vad = 0 | bER <= 0, vER very low, E < vEprev, bER > 0 | X | X | bER > 0, nacf_ap[2], nacf_ap[3] and nacf_ap[4] show increasing trend, zcr not very high, vER not too low, refl low, nacf_ap[3] not too low, nacf not too low bER <= 0 | bER > 0, nacf_ap[3], not very high, vER2 <– 15 |
| DOWN-TRANSIENT | Vad = 0 | DEFAULT | X | X | nacf_ap[2], nacf_ap[3] and nacf_ap[4] show increasing trend, nacf_ap[3] fairly high, nacf_ap[4] fairly high, vER not too low, E > 2*vEprev, etc. | vER not too low, zcr low |

Table 5 illustrates, in accordance with one configuration, the parameters evaluated by each state, and the state transitions when the third value (i.e. nacf_at_pitch[2]) is very low, or less than UNVOICEDTH. The decision table illustrated in Table 5 is used by the state machine described in FIG. 4B. The speech mode classification 246*a-b* of the previous frame of speech is shown in the leftmost column. When parameters are valued as shown in the row associated with each previous mode, the speech mode classification transitions to the current mode 246*a-b* identified in the top row of the associated column.

The initial state is Silence 450*b*. The current frame will always be classified as Silence 450*b*, regardless of the previous state, if vad=0 (i.e., there is no voice activity).

When the previous state is Silence 450*b*, the current frame may be classified as either Unvoiced 452*b* or Up-Transient 460*b*. The current frame is classified as Up-Transient 460*b* if nacf_at_pitch[2-4] show an increasing trend, nacf_at_pitch [3-4] have a moderate value, zcr 228*a-b* is very low to moderate, bER 234*a-b* is high, and vER 240*a-b* has a moderate value, or if a combination of these conditions are met. Otherwise the classification defaults to Unvoiced 452*b*.

When the previous state is Unvoiced 452*b*, the current frame may be classified as Unvoiced 452*b* or Up-Transient 460*b*. The current frame is classified as Up-Transient 460*b* if nacf_at_pitch[2-4] show an increasing trend, nacf_at_pitch [3-4] have a moderate to very high value, zcr 228*a-b* is very low or moderate, vER 240*a-b* is not low, bER 234*a-b* is high, refl 222*a-b* is low, nacf 224*a-b* has moderate value and E 230*a-b* is greater than vEprev 238*a-b*, or if a combination of these conditions is met. The combinations and thresholds for these conditions may vary depending on the noise level of the speech frame as reflected in the parameter ns_est 216*a-b* (or possibly multi-frame averaged SNR information 218). Otherwise the classification defaults to Unvoiced 452*b*.

When the previous state is Voiced 456*b*, Up-Transient 460*b*, or Transient 454*b*, the current frame may be classified as Unvoiced 452*b*, Transient 454*b*, or Down-Transient 458*b*. The current frame is classified as Unvoiced 452*b* if bER 234*a-b* is less than or equal to zero, vER 240*a* is very low, bER 234*a-b* is greater than zero, and E 230*a-b* is less than vEprev 238*a-b*, or if a combination of these conditions are met. The current frame is classified as Transient 454*b* if bER 234*a-b* is greater than zero, nacf_at_pitch[2-4] show an increasing trend, zcr 228*a-b* is not high, vER 240*a-b* is not low, refl 222*a-b* is low, nacf_at_pitch[3] and nacf 224*a-b* are moderate and bER 234*a-b* is less than or equal to zero, or if a certain combination of these conditions are met. The combinations and thresholds for these conditions may vary depending on the noise level of the speech frame as reflected in the parameter ns_est 216*a-b*. The current frame is classified as Down-Transient 458*a-b* if, bER 234*a-b* is greater than zero, nacf_at_pitch[3] is moderate, E 230*a-b* is less than vEprev 238*a-b*, zcr 228*a-b* is not high, and vER2 242*a-b* is less then negative fifteen.

When the previous frame is Down-Transient 458*b*, the current frame may be classified as Unvoiced 452*b*, Transient 454*b* or Down-Transient 458*b*. The current frame will be classified as Transient 454*b* if nacf_at_pitch[2-4] shown an increasing trend, nacf_at_pitch[3-4] are moderately high, vER 240*a-b* is not low, and E 230*a-b* is greater than twice vEprev 238*a-b*, or if a combination of these conditions are met. The current frame will be classified as Down-Transient 458*b* if vER 240*a-b* is not low and zcr 228*a-b* is low. Otherwise, the current classification defaults to Unvoiced 452*b*.

FIG. 4C illustrates one configuration of the state machine selected in one configuration when vad 220*a-b* is 1 (there is active speech) and the third value of nacf_at_pitch 226*a-b* (i.e. nacf_at_pitch[3]) is moderate, i.e., greater than UNVOICEDTH and less than VOICEDTH. UNVOICEDTH and VOICEDTH are defined in step 306 of FIG. 3. Table 6 illustrates the parameters evaluated by each state.

TABLE 6

| | PREVIOUS | | | | | |
|---|---|---|---|---|---|---|
| CURRENT | SILENCE | UNVOICED | VOICED | UP-TRANSIENT | TRANSIENT | DOWN-TRANSIENT |
| SILENCE | Vad = 0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low | X | X |
| UNVOICED | Vad = 0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low, nacf_ap[3] very high, nacf_ap[4] very high, refl low, E > vEprev, nacf not to low, etc. | X | X |
| VOICED, UP-TRANSIENT, TRANSIENT | Vad = 0 | bER <= 0, vER very low, E < vEprev, bER > 0 | X | X | bER > 0, nacf_ap[2], nacf_ap[3] and nacf_ap[4] show increasing trend, zcr not very high, vER not too low, refl low, nacf_ap[3] not too low, nacf not too low bER <= 0 | bER > 0, nacf_ap[3], not very high, vER2 <− 15 |
| DOWN-TRANSIENT | Vad = 0 | DEFAULT | X | X | nacf_ap[2], nacf_ap[3] and nacf_ap[4] show increasing trend, nacf_ap[3] fairly high, nacf_ap[4] fairly high, vER not too low, E > 2*vEprev, etc. | vER not too low, zcr low |

Table 6 illustrates, in accordance with one embodiment, the parameters evaluated by each state, and the state transitions when the third value of nacf_at_pitch 226*a-b* (i.e. nacf_at_pitch[3]) is moderate, i.e., greater than UNVOICEDTH but less than VOICEDTH. The decision table illustrated in Table 6 is used by the state machine described in FIG. 4C. The speech mode classification of the previous frame of speech is shown in the leftmost column. When parameters are valued as shown in the row associated with each previous mode, the speech mode classification 246*a-b* transitions to the current mode 246*a-b* identified in the top row of the associated column.

The initial state is Silence 450*c*. The current frame will always be classified as Silence 450*c*, regardless of the previous state, if vad=0 (i.e., there is no voice activity).

When the previous state is Silence 450*c*, the current frame may be classified as either Unvoiced 452*c* or Up-transient 460*c*. The current frame is classified as Up-Transient 460*c* if nacf_at_pitch[2-4] shown an increasing trend, nacf_at_pitch [3-4] are moderate to high, zcr 228*a-b* is not high, bER 234*a-b* is high, vER 240*a-b* has a moderate value, zcr 228*a-b* is very low and E 230*a-b* is greater than twice vEprev 238*a-b*, or if a certain combination of these conditions are met. Otherwise the classification defaults to Unvoiced 452*c*.

When the previous state is Unvoiced 452*c*, the current frame may be classified as Unvoiced 452*c* or Up-Transient 460*c*. The current frame is classified as Up-Transient 460*c* if nacf_at_pitch[2-4] shown an increasing trend, nacf_at_pitch [3-4] have a moderate to very high value, zcr 228*a-b* is not high, vER 240*a-b* is not low, bER 234*a-b* is high, refl 222*a-b* is low, E 230*a-b* is greater than vEprev 238*a-b*, zcr 228*a-b* is very low, nacf 224*a-b* is not low, maxsfe_idx 244*a-b* points to the last subframe and E 230*a-b* is greater than twice vEprev 238*a-b*, or if a combination of these conditions are met. The combinations and thresholds for these conditions may vary depending on the noise level of the speech frame as reflected in the parameter ns_est 216*a-b* (or possibly multi-frame averaged SNR information 218). Otherwise the classification defaults to Unvoiced 452*c*.

When the previous state is Voiced 456*c*, Up-Transient 460*c*, or Transient454*c*, the current frame may be classified as Unvoiced 452*c*, Voiced 456*c*, Transient 454*c*, Down-Transient 458*c*. The current frame is classified as Unvoiced 452*c* if bER 234*a-b* is less than or equal to zero, vER 240*a-b* is very low, Enext 232*a-b* is less than E 230*a-b*, nacf_at_pitch[3-4] are very low, bER 234*a-b* is greater than zero and E 230*a-b* is less than vEprev 238*a-b*, or if a certain combination of these conditions are met. The current frame is classified as Transient 454*c* if bER 234*a-b* is greater than zero, nacf_at_pitch [2-4] show an increasing trend, zcr 228*a-b* is not high, vER 240*a-b* is not low, refl 222*a-b* is low, nacf_at_pitch[3] and nacf 224*a-b* are not low, or if a combination of these conditions are met. The combinations and thresholds for these conditions may vary depending on the noise level of the speech frame as reflected in the parameter ns_est 216*a-b* (or possibly multi-frame averaged SNR information 218). The current frame is classified as Down-Transient 458*c* if, bER 234*a-b* is greater than zero, nacf_at_pitch[3] is not high, E 230*a-b* is less than vEprev 238*a-b*, zcr 228*a-b* is not high, vER 240-*ab* is less than negative fifteen and vER2 242*a-b* is less then negative fifteen, or if a combination of these conditions are met. The current frame is classified as Voiced 456*c* if nacf_at_pitch[2] is greater than LOWVOICEDTH, bER 234*a-b* is greater than or equal to zero, and vER 240*a-b* is not low, or if a combination of these conditions are met.

When the previous frame is Down-Transient 458*c*, the current frame may be classified as Unvoiced 452*c*, Transient 454*c* or Down-Transient 458*c*. The current frame will be classified as Transient 454*c* if bER 234*a-b* is greater than zero, nacf_at_pitch[2-4] show an increasing trend, nacf_at_pitch[3-4] are moderately high, vER 240*a-b* is not low, and E 230*a-b* is greater than twice vEprev 238*a-b*, or if a certain combination of these conditions are met. The current frame will be classified as Down-Transient 458*c* if vER 240*a-b* is not low and zcr 228*a-b* is low. Otherwise, the current classification defaults to Unvoiced 452*c*.

Figure 5:
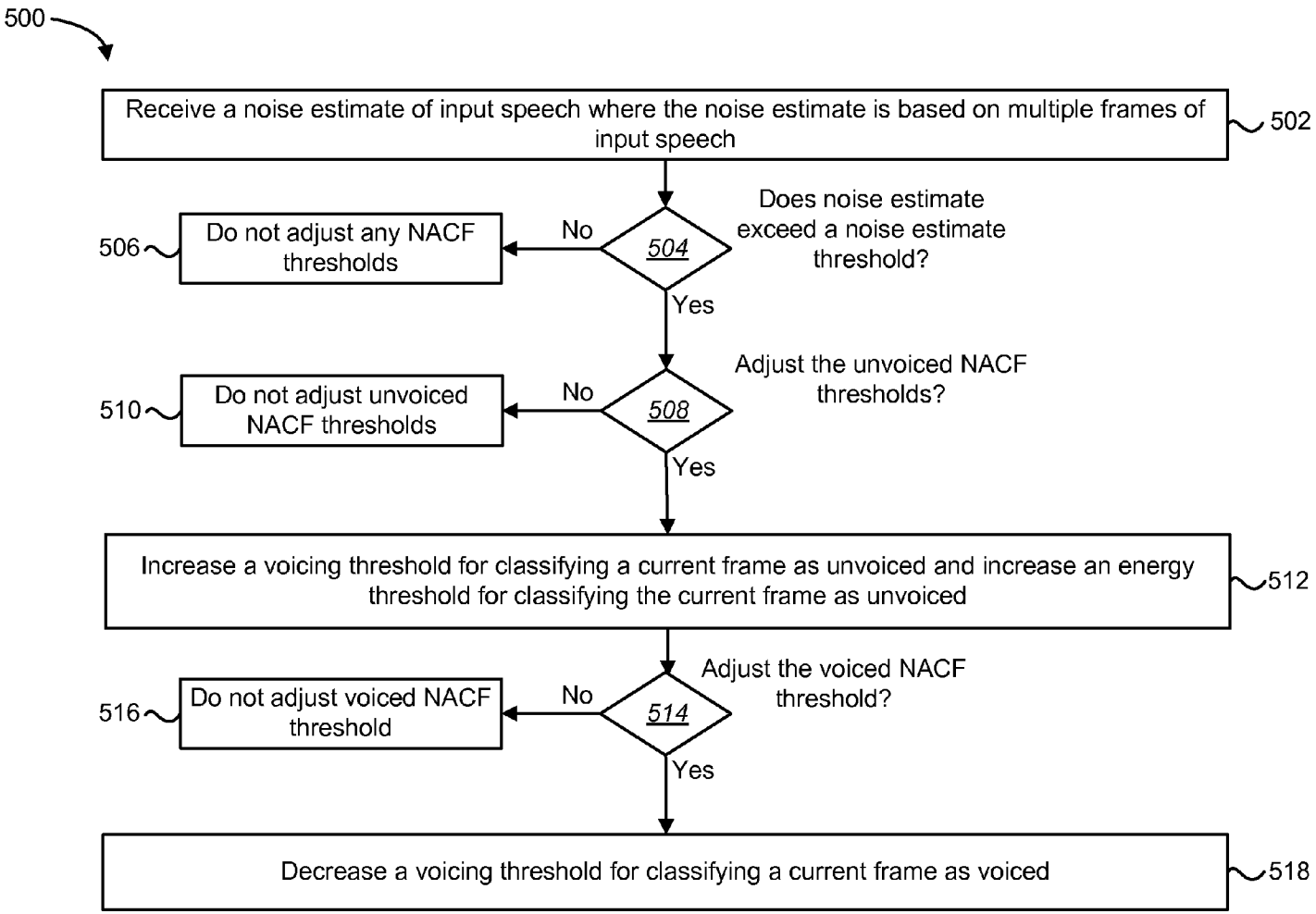
FIG. 5 is a flow diagram illustrating a method for adjusting thresholds for classifying speech.

FIG. 5 is a flow diagram illustrating a method 500 for adjusting thresholds for classifying speech. The adjusted thresholds (e.g., NACF, or periodicity, thresholds) may then be used, for example, in the method 300 of noise-robust speech classification illustrated in FIG. 3. The method 500 may be performed by the speech classifiers 210*a-b* illustrated in FIGS. 2A-2B.

A noise estimate (e.g., ns_est 216*a-b*), of input speech may be received 502 at the speech classifier 210*a-b*. The noise estimate may be based on multiple frames of input speech. Alternatively, an average of multi-frame SNR information 218 may be used instead of a noise estimate. Any suitable noise metric that is relatively stable over multiple frames may be used in the method 500. The speech classifier 210*a-b* may determine 504 whether the noise estimate exceeds a noise estimate threshold. Alternatively, the speech classifier 210*a-b* may determine if the multi-frame SNR information 218 fails to exceed a multi-frame SNR threshold. If not, the speech classifier 210*a-b* may not 506 adjust any NACF thresholds for classifying speech as either "voiced" or "unvoiced." However, if the noise estimate exceeds the noise estimate threshold, the speech classifier 210*a-b* may also determine 508 whether to adjust the unvoiced NACF thresholds. If no, the unvoiced NACF thresholds may not 510 be adjusted, i.e., the thresholds for classifying a frame as "unvoiced" may not be adjusted. If yes, the speech classifier 210*a-b* may increase 512 the unvoiced NACF thresholds, i.e., increase a voicing threshold for classifying a current frame as unvoiced and increase an energy threshold for classifying the current frame as unvoiced. Increasing the voicing threshold and the energy threshold for classifying a frame as "unvoiced" may make it easier (i.e., more permissive) to classify a frame as unvoiced as the noise estimate gets higher (or the SNR gets lower). The speech classifier 210*a-b* may also determine 514 whether to adjust the voiced NACF threshold (alternatively, spectral tilt or transient detection or zero-crossing rate thresholds may be adjusted). If no, the speech classifier 210*a-b* may not 516 adjust the voicing threshold for classifying a frame as "voiced," i.e., the thresholds for classifying a frame as "voiced" may not be adjusted. If yes, the speech classifier 210*a-b* may decrease 518 a voicing threshold for classifying a current frame as "voiced." Therefore, the NACF thresholds for classifying a speech frame as either "voiced" or "unvoiced" may be adjusted independently of each other. For example, depending on how the classifier 610 is tuned in the clean (no noise) case, only one of the "voiced" or "unvoiced" thresholds may be adjusted independently, i.e., it can be the case that the "unvoiced" classification is much more sensitive to the noise. Furthermore, the penalty for misclassifying a "voiced" frame may be bigger than for misclassifying an "unvoiced" frame (both in terms of quality and bit rate).

Figure 6:
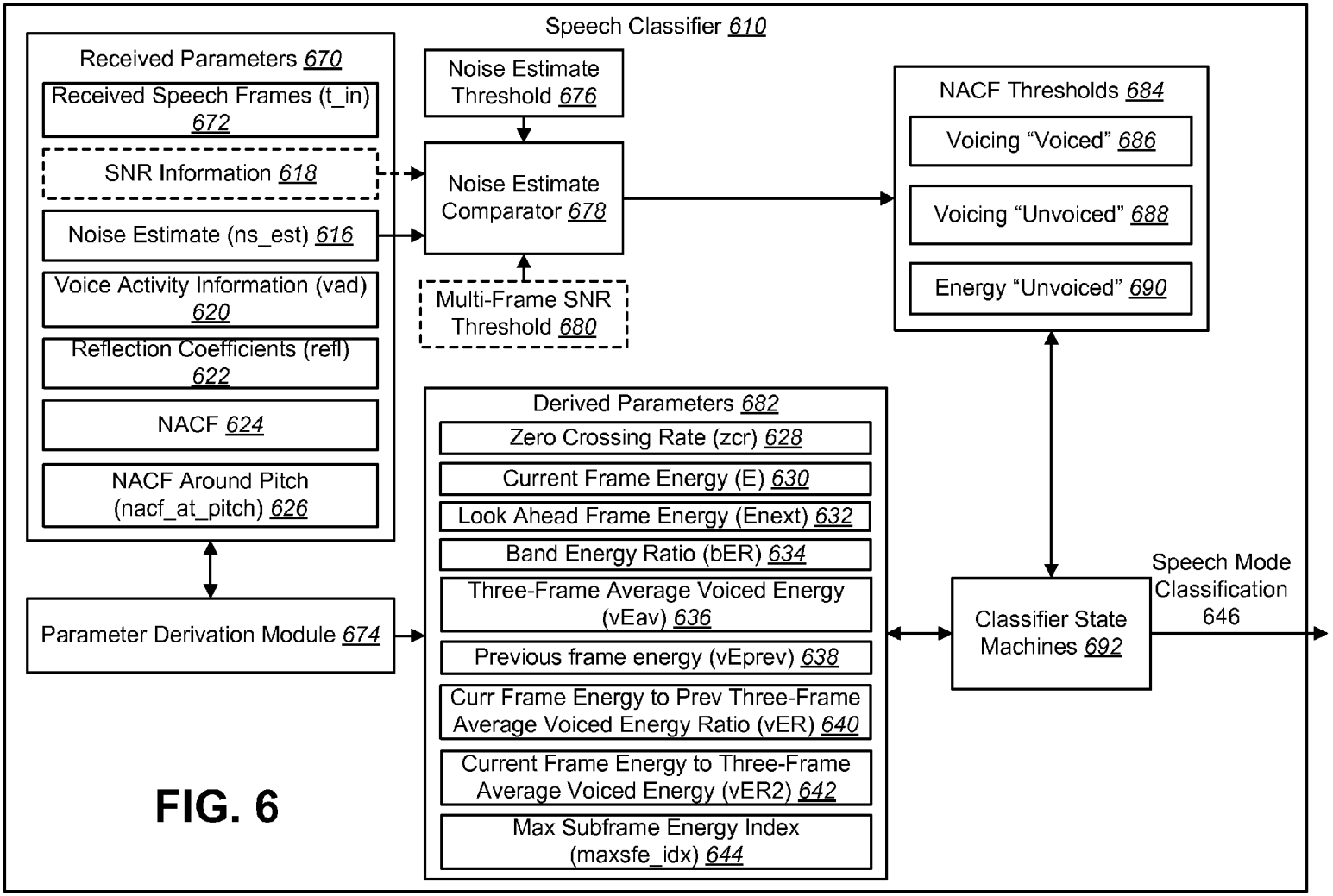
FIG. 6 is a block diagram illustrating a speech classifier for noise-robust speech classification.

FIG. 6 is a block diagram illustrating a speech classifier 610 for noise-robust speech classification. The speech classifier 610 may correspond to the speech classifiers 210*a-b* illustrated in FIGS. 2A-2B and may perform the method 300 illustrated in FIG. 3 or the method 500 illustrated in FIG. 5.

The speech classifier 610 may include received parameters 670. This may include received speech frames (t_in) 672, SNR information 618, a noise estimate (ns_est) 616, voice activity information (vad) 620, reflection coefficients (refl) 622, NACF 624 and NACF around pitch (nacf_at_pitch) 626. These parameters 670 may be received from various modules such as those illustrated in FIGS. 2A-2B. For example, the received speech frames (t_in) 672 may be the output speech frames 214*a* from a noise suppressor 202 illustrated in FIG. 2A or the input speech 212*b* itself as illustrated in FIG. 2*b*.

A parameter derivation module 674 may also determine a set of derived parameters 682. Specifically, the parameter derivation module 674 may determine a zero crossing rate (zcr) 628, a current frame energy (E) 630, a look ahead frame energy (Enext) 632, a band energy ratio (bER) 634, a three frame average voiced energy (vEav) 636, a previous frame energy (vEprev) 638, a current energy to previous three-frame average voiced energy ratio (vER) 640, a current frame energy to three-frame average voiced energy (vER2) 642 and a max sub-frame energy index (maxsfe_idx) 644.

A noise estimate comparator 678 may compare the received noise estimate (ns_est) 616 with a noise estimate threshold 676. If the noise estimate (ns_est) 616 does not exceed the noise estimate threshold 676, a set of NACF thresholds 684 may not be adjusted. However, if the noise estimate (ns_est) 616 exceeds the noise estimate threshold 676 (indicating the presence of high noise), one or more of the NACF thresholds 684 may be adjusted. Specifically, a voicing threshold for classifying "voiced" frames 686 may be decreased, a voicing threshold for classifying "unvoiced" frames 688 may be increased, an energy threshold for classifying "unvoiced" frames 690 may be increased, or some combination of adjustments. Alternatively, instead of comparing the noise estimate (ns_est) 616 to the noise estimate threshold 676, the noise estimate comparator may compare SNR information 618 to a multi-frame SNR threshold 680 to determine whether to adjust the NACF thresholds 684. In that configuration, the NACF thresholds 684 may be adjusted if the SNR information 618 fails to exceed the multi-frame SNR threshold 680, i.e., the NACF thresholds 684 may be adjusted when the SNR information 618 falls below a minimum level, thus indicating the presence of high noise. Any suitable noise metric that is relatively stable across multiple frames may be used by the noise estimate comparator 678.

A classifier state machine 692 may then be selected and used to determine a speech mode classification 646 based at least, in part, on the derived parameters 682, as described above and illustrated in FIGS. 4A-4C and Tables 4-6.

Figure 7:
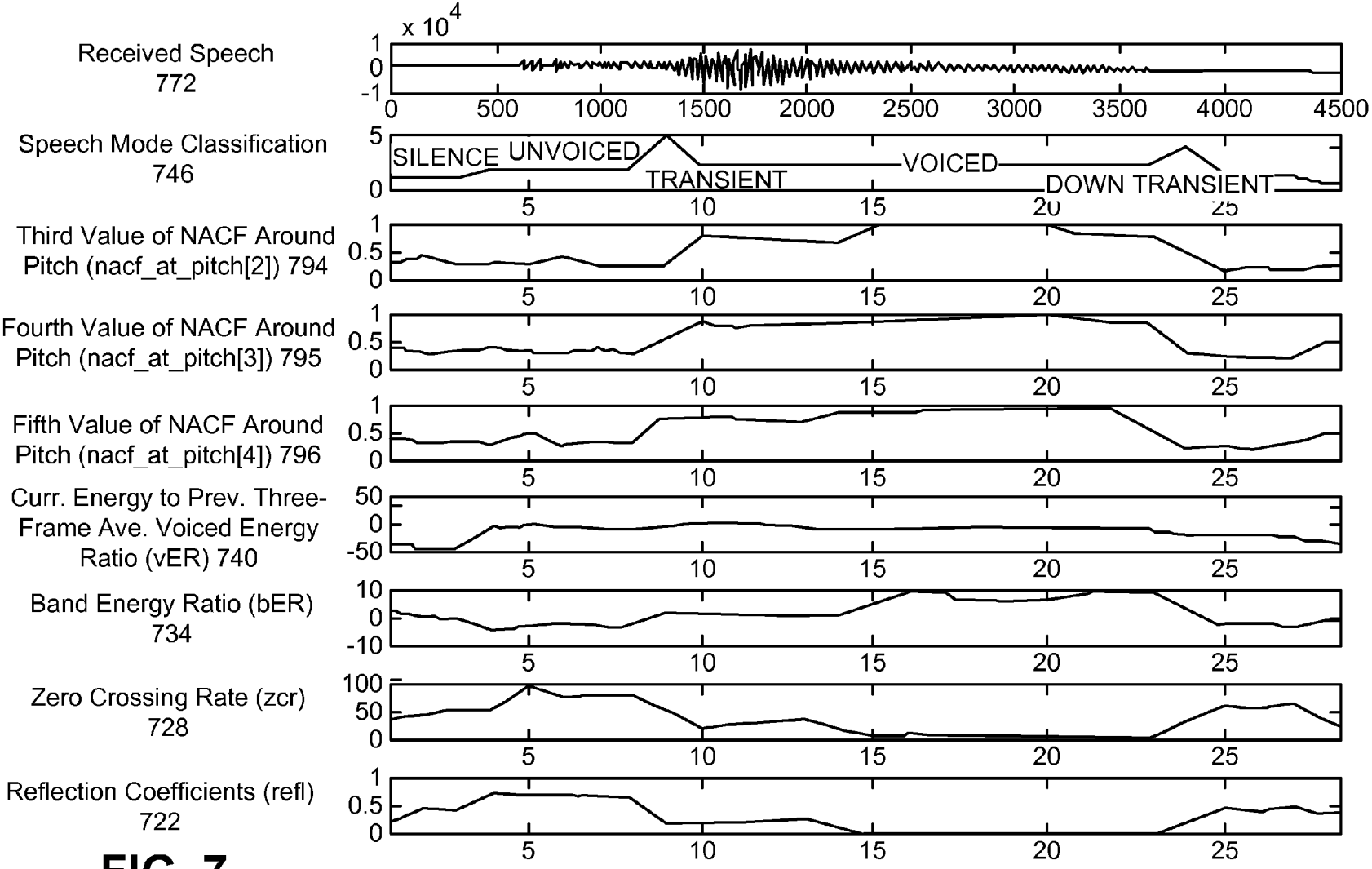
FIG. 7 is a timeline graph illustrating one configuration of a received speech signal with associated parameter values and speech mode classifications.

FIG. 7 is a timeline graph illustrating one configuration of a received speech signal 772 with associated parameter values and speech mode classifications 746. Specifically, FIG. 7 illustrates one configuration of the present systems and methods in which the speech mode classification 746 is chosen based on various received parameters 670 and derived parameters 682. Each signal or parameter is illustrated in FIG. 7 as a function of time.

For example, the third value of NACF around pitch (nacf_at_pitch[2]) 794, the fourth value of NACF around pitch (nacf_at_pitch[3]) 795 and the fifth value of NACF around pitch (nacf_at_pitch[4]) 796 are shown. Furthermore, the current energy to previous three-frame average voiced energy ratio (vER) 740, band energy ratio (bER) 734, zero crossing rate (zcr) 728 and reflection coefficients (refl) 722 are also shown. Based on the illustrated signals, the received speech 772 may be classified as Silence around time 0, Unvoiced around time 4, Transient around time 9, Voiced around time 10 and Down-Transient around time 25.

Figure 8:
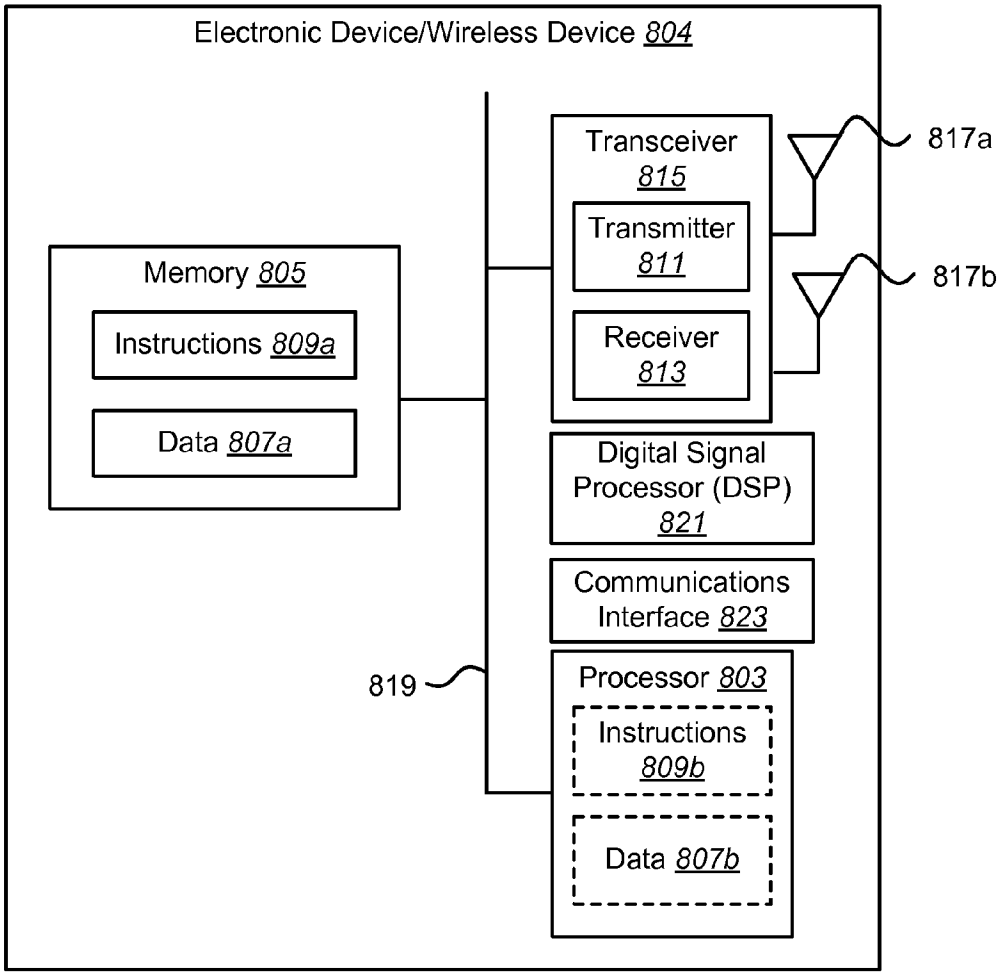
FIG. 8 illustrates certain components that may be included within an electronic device/wireless device.

FIG. 8 illustrates certain components that may be included within an electronic device/wireless device 804. The electronic device/wireless device 804 may be an access terminal, a mobile station, a user equipment (UE), a base station, an access point, a broadcast transmitter, a node B, an evolved node B, etc. The electronic device/wireless device 804 includes a processor 803. The processor 803 may be a general purpose single- or multi-chip microprocessor (e.g., an ARM), a special purpose microprocessor (e.g., a digital signal processor (DSP)), a microcontroller, a programmable gate array, etc. The processor 803 may be referred to as a central processing unit (CPU). Although just a single processor 803 is shown in the electronic device/wireless device 804 of FIG. 8, in an alternative configuration, a combination of processors (e.g., an ARM and DSP) could be used.

The electronic device/wireless device 804 also includes memory 805. The memory 805 may be any electronic component capable of storing electronic information. The memory 805 may be embodied as random access memory (RAM), read-only memory (ROM), magnetic disk storage media, optical storage media, flash memory devices in RAM, on-board memory included with the processor, EPROM memory, EEPROM memory, registers, and so forth, including combinations thereof.

Data 807*a* and instructions 809*a* may be stored in the memory 805. The instructions 809*a* may be executable by the processor 803 to implement the methods disclosed herein. Executing the instructions 809*a* may involve the use of the data 807*a* that is stored in the memory 805. When the processor 803 executes the instructions 809*a*, various portions of the instructions 809*b* may be loaded onto the processor 803, and various pieces of data 807*b* may be loaded onto the processor 803.

The electronic device/wireless device 804 may also include a transmitter 811 and a receiver 813 to allow transmission and reception of signals to and from the electronic device/wireless device 804. The transmitter 811 and receiver 813 may be collectively referred to as a transceiver 815. Multiple antennas 817*a-b* may be electrically coupled to the transceiver 815. The electronic device/wireless device 804 may also include (not shown) multiple transmitters, multiple receivers, multiple transceivers and/or additional antennas.

The electronic device/wireless device 804 may include a digital signal processor (DSP) 821. The electronic device/wireless device 804 may also include a communications interface 823. The communications interface 823 may allow a user to interact with the electronic device/wireless device 804.

The various components of the electronic device/wireless device 804 may be coupled together by one or more buses, which may include a power bus, a control signal bus, a status signal bus, a data bus, etc. For the sake of clarity, the various buses are illustrated in FIG. 8 as a bus system 819.

The techniques described herein may be used for various communication systems, including communication systems that are based on an orthogonal multiplexing scheme. Examples of such communication systems include Orthogonal Frequency Division Multiple Access (OFDMA) systems, Single-Carrier Frequency Division Multiple Access (SC-FDMA) systems, and so forth. An OFDMA system utilizes orthogonal frequency division multiplexing (OFDM), which is a modulation technique that partitions the overall system bandwidth into multiple orthogonal sub-carriers. These sub-carriers may also be called tones, bins, etc. With OFDM, each sub-carrier may be independently modulated with data. An SC-FDMA system may utilize interleaved FDMA (IFDMA) to transmit on sub-carriers that are distributed across the system bandwidth, localized FDMA (LFDMA) to transmit on a block of adjacent sub-carriers, or enhanced FDMA (EFDMA) to transmit on multiple blocks of adjacent sub-carriers. In general, modulation symbols are sent in the frequency domain with OFDM and in the time domain with SC-FDMA.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The term "processor" should be interpreted broadly to encompass a general purpose processor, a central processing unit (CPU), a microprocessor, a digital signal processor (DSP), a controller, a microcontroller, a state machine, and so forth. Under some circumstances, a "processor" may refer to an application specific integrated circuit (ASIC), a programmable logic device (PLD), a field programmable gate array (FPGA), etc. The term "processor" may refer to a combination of processing devices, e.g., a combination of a DSP and a microprocessor, a plurality of microprocessors, one or more microprocessors in conjunction with a DSP core, or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable statement (s). For example, the terms "instructions" and "code" may refer to one or more programs, routines, sub-routines, functions, procedures, etc. "Instructions" and "code" may comprise a single computer-readable statement or many computer-readable statements.

The functions described herein may be implemented in software or firmware being executed by hardware. The functions may be stored as one or more instructions on a computer-readable medium. The terms "computer-readable medium" or "computer-program product" refers to any tangible storage medium that can be accessed by a computer or a processor. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

Further, it should be appreciated that modules and/or other appropriate means for performing the methods and techniques described herein, such as those illustrated by FIGS. 3 and 5, can be downloaded and/or otherwise obtained by a device. For example, a device may be coupled to a server to facilitate the transfer of means for performing the methods described herein. Alternatively, various methods described herein can be provided via a storage means (e.g., random access memory (RAM), read only memory (ROM), a physical storage medium such as a compact disc (CD) or floppy disk, etc.), such that a device may obtain the various methods upon coupling or providing the storage means to the device.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method of noise-robust speech classification, comprising:

inputting classification parameters to a speech classifier from external components;

generating, in the speech classifier, internal classification parameters from at least one of the input classification parameters;

setting a Normalized Auto-correlation Coefficient Function threshold, wherein setting the Normalized Auto-correlation Coefficient Function threshold comprises:

increasing a first voicing threshold for classifying a current frame as unvoiced when a signal-to-noise ratio (SNR) fails to exceed a first SNR threshold, wherein the first voicing threshold is not adjusted if the SNR is above the first SNR threshold, and increasing an energy threshold for classifying the current frame as unvoiced when the noise estimate exceeds a noise estimate threshold, wherein the energy threshold is not adjusted if the noise estimate is below the noise estimate threshold; and determining a speech mode classification based on a the first voicing threshold and the energy threshold.

2. The method of claim 1, wherein setting the Normalized Auto-correlation Coefficient Function threshold further comprises decreasing a second voicing threshold for classifying a current frame as voiced when the SNR fails to exceed a second SNR threshold, wherein the second voicing threshold is not adjusted if the SNR is above the second SNR threshold.

3. The method of claim 1, wherein the input parameters comprise a noise suppressed speech signal.

4. The method of claim 1, wherein the input parameters comprise voice activity information.

5. The method of claim 1, wherein the input parameters comprise Linear Prediction reflection coefficients.

6. The method of claim 1, wherein the input parameters comprise Normalized Auto-correlation Coefficient Function information.

7. The method of claim 1, wherein the input parameters comprise Normalized Auto-correlation Coefficient Function at pitch information.

8. The method of claim 7, wherein the Normalized Auto-correlation Coefficient Function at pitch information is an array of values.

9. The method of claim 1, wherein the internal parameters comprise a zero crossing rate parameter.

10. The method of claim 1, wherein the internal parameters comprise a current frame energy parameter.

11. The method of claim 1, wherein the internal parameters comprise a look ahead frame energy parameter.

12. The method of claim 1, wherein the internal parameters comprise a band energy ratio parameter.

13. The method of claim 1, wherein the internal parameters comprise a three frame averaged voiced energy parameter.

14. The method of claim 1, wherein the internal parameters comprise a previous three frame average voiced energy parameter.

15. The method of claim 1, wherein the internal parameters comprise a current frame energy to previous three frame average voiced energy ratio parameter.

16. The method of claim 1, wherein the internal parameters comprise a current frame energy to three frame average voiced energy parameter.

17. The method of claim 1, wherein the internal parameters comprise a maximum sub-frame energy index parameter.

18. The method of claim 1, wherein the setting a Normalized Auto-correlation Coefficient Function threshold comprises comparing the noise estimate to a pre-determined Signal to a noise estimate threshold.

19. The method of claim 1, wherein the parameter analyzer applies the parameters to a state machine.

20. The method of claim 19, wherein the state machine comprises a state for each speech classification mode.

21. The method of claim 1, wherein the speech mode classification comprises a Transient mode.

22. The method of claim 1, wherein the speech mode classification comprises an Up-Transient mode.

23. The method of claim 1, wherein the speech mode classification comprises a Down-Transient mode.

24. The method of claim 1, wherein the speech mode classification comprises a Voiced mode.

25. The method of claim 1, wherein the speech mode classification comprises an Unvoiced mode.

26. The method of claim 1, wherein the speech mode classification comprises a Silence mode.

27. The method of claim 1, further comprising updating at least one parameter.

28. The method of claim 27, wherein the updated parameter comprises a Normalized Auto-correlation Coefficient Function at pitch parameter.

29. The method of claim 27, wherein the updated parameter comprises a three frame averaged voiced energy parameter.

30. The method of claim 27, wherein the updated parameter comprises a look ahead frame energy parameter.

31. The method of claim 27, wherein the updated parameter comprises a previous three frame average voiced energy parameter.

32. The method of claim 27, wherein the updated parameter comprises a voice activity detection parameter.

33. An apparatus for noise-robust speech classification, comprising:

a processor;

memory in electronic communication with the processor;

instructions stored in the memory, the instructions being executable by the processor to:

input classification parameters to a speech classifier from external components;

generate, in the speech classifier, internal classification parameters from at least one of the input classification parameters;

set a Normalized Auto-correlation Coefficient Function threshold, wherein the instructions executable to set the Normalized Auto-correlation Coefficient Function threshold further comprise instructions executable to:

increase a first voicing threshold for classifying a current frame as unvoiced when a signal-to-noise ratio (SNR) fails to exceed a first SNR threshold, wherein the first voicing threshold is not adjusted if the SNR is above the first SNR threshold, and increase an energy threshold for classifying the current frame as unvoiced when the noise estimate exceeds a noise estimate threshold, wherein the energy threshold is not adjusted if the noise estimate is below the noise estimate threshold; and determine a speech mode classification based on the first voicing threshold and the energy threshold.

34. The apparatus of claim 33, wherein the instructions executable to set the Normalized Auto-correlation Coefficient Function threshold further comprise instructions executable to decrease a second voicing threshold for classifying a current frame as voiced when the SNR fails to exceed a second SNR threshold, wherein the second voicing threshold is not adjusted if the SNR is above the second SNR threshold.

35. The apparatus of claim 33, wherein the input parameters comprise one or more of a noise suppressed speech signal, voice activity information, Linear Prediction reflection coefficients, Normalized Auto-correlation Coefficient Function information and Normalized Auto-correlation Coefficient Function at pitch information.

36. The apparatus of claim 35, wherein the Normalized Auto-correlation Coefficient Function at pitch information is an array of values.

37. The apparatus of claim 35, wherein the internal parameters comprise one or more of a zero crossing rate parameter, a current frame energy parameter, a look ahead frame energy parameter, a band energy ratio parameter, a three frame averaged voiced energy parameter, a previous three frame average voiced energy parameter, a current frame energy to previous three frame average voiced energy ratio parameter, a current frame energy to three frame average voiced energy parameter and a maximum sub-frame energy index parameter.

38. The apparatus of claim 33, further comprising instructions executable to update at least one parameter.

39. The apparatus of claim 38, wherein the updated parameter comprises one or more of a Normalized Auto-correlation Coefficient Function at pitch parameter, a three frame averaged voiced energy parameter, a look ahead frame energy parameter, a previous three frame average voiced energy parameter and a voice activity detection parameter.

40. An apparatus for noise-robust speech classification, comprising:

means for inputting classification parameters to a speech classifier from external components;

means for generating, in the speech classifier, internal classification parameters from at least one of the input classification parameters;

means for setting a Normalized Auto-correlation Coefficient Function threshold, wherein the means for setting the Normalized Auto-correlation Coefficient Function threshold comprise:

means for increasing a first voicing threshold for classifying a current frame as unvoiced when a signal-to-noise ratio (SNR) fails to exceed a first SNR threshold, wherein the first voicing threshold is not adjusted if the SNR is above the first SNR threshold, and means for increasing an energy threshold for classifying the current frame as unvoiced when the noise estimate exceeds a noise estimate threshold, wherein the energy threshold is not adjusted if the noise estimate is below the noise estimate threshold; and means for determining a speech mode classification based on the first voicing threshold and the energy threshold.

41. The apparatus of claim 40, wherein the means for setting the Normalized Auto-correlation Coefficient Function threshold further comprise means for decreasing a second voicing threshold for classifying a current frame as voiced when the SNR fails to exceed a second SNR threshold, wherein the second voicing threshold is not adjusted if the SNR is above the second SNR threshold.

42. A computer-program product for noise-robust speech classification, the computer-program product comprising a non-transitory computer-readable medium having instructions thereon, the instructions, comprising:

code for inputting classification parameters to a speech classifier from external components;

code for generating, in the speech classifier, internal classification parameters from at least one of the input classification parameters;

code for setting a Normalized Auto-correlation Coefficient Function threshold, wherein the code for setting the Normalized Auto-correlation Coefficient Function threshold comprises:

code for increasing a first voicing threshold for classifying a current frame as unvoiced when the noise estimate exceeds a noise estimate threshold a signal-to-noise ratio (SNR) fails to exceed a first SNR threshold, wherein the first voicing threshold is not adjusted if the SNR is above the first SNR threshold; and code for increasing an energy threshold for classifying the current frame as unvoiced when the noise estimate exceeds a noise estimate threshold, wherein the voicing threshold and the energy threshold is not adjusted if the noise estimate is below the noise estimate threshold; and code for determining a speech mode classification based on the first voicing threshold and the energy threshold.

43. The computer-program product of claim 42, wherein the code for setting the Normalized Auto-correlation Coefficient Function threshold comprises code for decreasing a second voicing threshold for classifying a current frame as voiced when the SNR fails to exceed a second SNR threshold, wherein the second voicing threshold is not adjusted if the SNR is above the SNR threshold.

* * * * *